US010073394B2

(12) United States Patent
Sato et al.

(10) Patent No.: US 10,073,394 B2
(45) Date of Patent: Sep. 11, 2018

(54) IMAGE FORMING APPARATUS AND FIXING DEVICE

(71) Applicant: FUJI XEROX CO., LTD., Toyko (JP)

(72) Inventors: Kunihiko Sato, Kanagawa (JP); Kosuke Yamada, Kanagawa (JP); Kazutoshi Sugitani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/452,987

(22) Filed: Mar. 8, 2017

(65) Prior Publication Data

US 2018/0011436 A1 Jan. 11, 2018

(30) Foreign Application Priority Data

Jul. 8, 2016 (JP) ..... 2016-136305

(51) Int. Cl.
*G03G 15/16* (2006.01)
*G03G 15/20* (2006.01)

(52) U.S. Cl.
CPC ..... *G03G 15/2085* (2013.01); *G03G 15/1605* (2013.01); *G03G 15/2067* (2013.01)

(58) Field of Classification Search
CPC ..... G03G 15/1605; G03G 15/2067; G03G 15/2085; G03G 2221/1639; G03G 2215/00459
See application file for complete search history.

(56) References Cited

U.S. PATENT DOCUMENTS 5,315,359 A * 5/1994 Nishikawa ..... G03G 15/2028 271/308
5,493,377 A 2/1996 Nishikawa et al.
2016/0004194 A1* 1/2016 Kondo ..... G03G 15/2028 399/323

FOREIGN PATENT DOCUMENTS

JP 2011-22473 A 2/2011

* cited by examiner

*Primary Examiner* — Hoang Ngo
(74) *Attorney, Agent, or Firm* — Sughrue Mion, PLLC

(57) ABSTRACT

An image forming apparatus includes an image carrier; a transfer unit that transfers an image carried by the image carrier to a continuous medium; a fixing device including a first fixing member that contacts the continuous medium and heats the image transferred to the continuous medium and a second fixing member that is disposed so as to face the first fixing member with the continuous medium therebetween and presses the image, the fixing device fixing the image transferred to the continuous medium, the fixing device being configured so that the first fixing member and the second fixing member are capable of contacting or separating from each other; and a separation member that contacts the continuous medium and separates the continuous medium from the first fixing member when the first fixing member and the second fixing member separate from each other.

21 Claims, 14 Drawing Sheets

IMAGE FORMING APPARATUS AND FIXING DEVICE

CROSS-REFERENCE TO RELATED APPLICATIONS

This application is based on and claims priority under 35 USC 119 from Japanese Patent Application No. 2016-136305 filed Jul. 8, 2016.

BACKGROUND

Technical Field

The present invention relates to an image forming apparatus and a fixing device.

SUMMARY

According to an aspect of the invention, an image forming apparatus includes an image carrier; a transfer unit that transfers an image carried by the image carrier to a continuous medium; a fixing device including a first fixing member that contacts the continuous medium and heats the image transferred to the continuous medium and a second fixing member that is disposed so as to face the first fixing member with the continuous medium therebetween and presses the image, the fixing device fixing the image transferred to the continuous medium, the fixing device being configured so that the first fixing member and the second fixing member are capable of contacting or separating from each other; and a separation member that contacts the continuous medium and separates the continuous medium from the first fixing member when the first fixing member and the second fixing member separate from each other.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the invention will be described with reference to the drawings. Note that the present invention is not limited to the exemplary embodiment described below.

To facilitate understanding the following description, the directions in the figures are defined as follows: the front-back direction is the X-axis direction, the left-right direction is the Y-axis direction, and the up-down direction is the Z-axis direction. The directions indicated by arrows X, −X, Y, −Y, Z, and −Z are respectively defined as forward, backward, rightward, leftward, upward, and downward; or the front side, the back side, the right side, the left side, the upper side, and the lower side.

In each of the figures, a symbol "o" with "•" in it represents an arrow extending from the back side toward the front side of the plane of the figure, and a symbol "o" with "x" in it represents an arrow extending from the front side toward the back side of the plane of the figure.

In the figures, members that are not necessary for understanding the following descriptions are not illustrated.

Exemplary Embodiment

Figure 1:
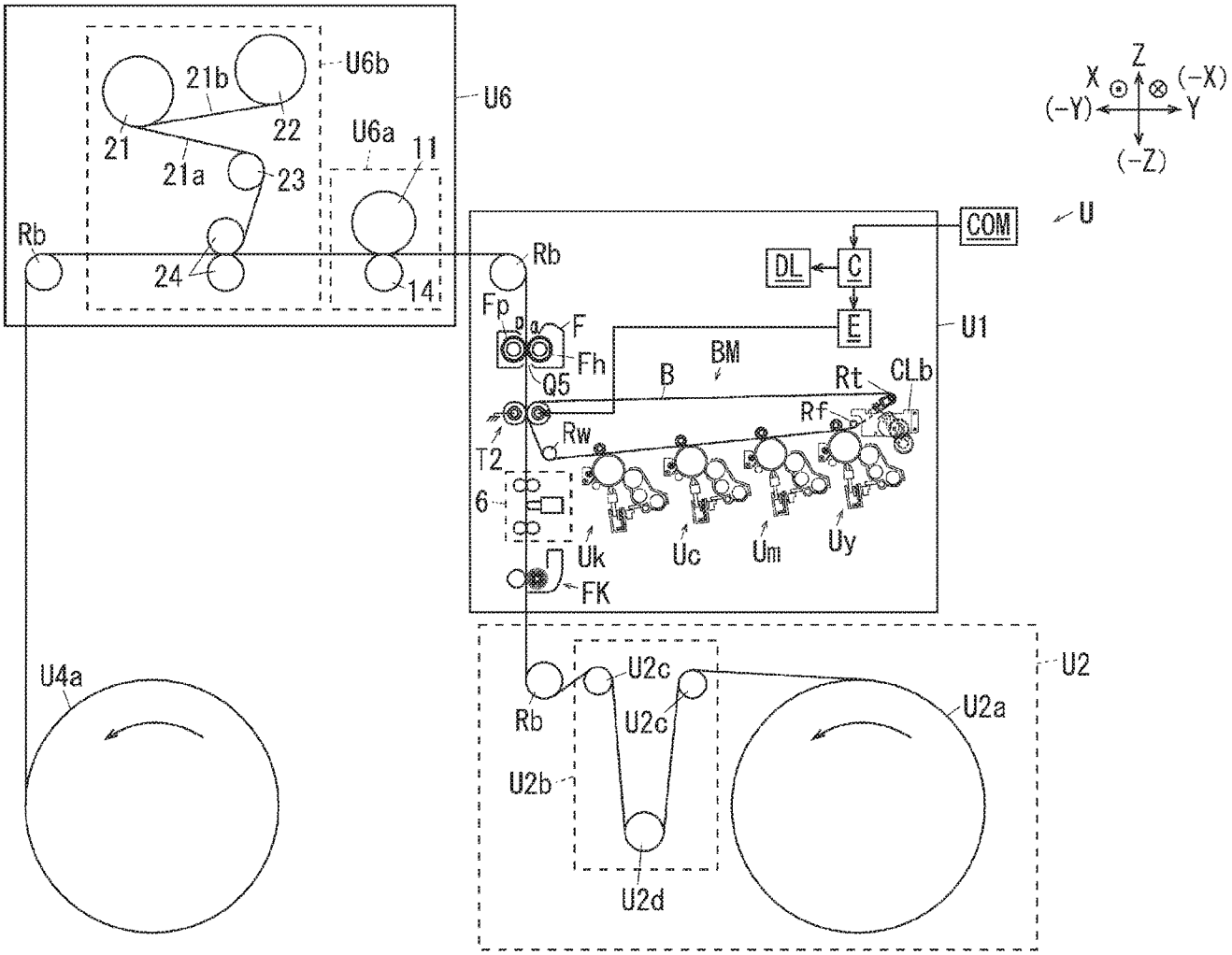
FIG. 1 is an overall view of an image forming apparatus according to the exemplary embodiment.

FIG. 1 is an overall view of an image forming apparatus according to an exemplary embodiment.

Figure 2:
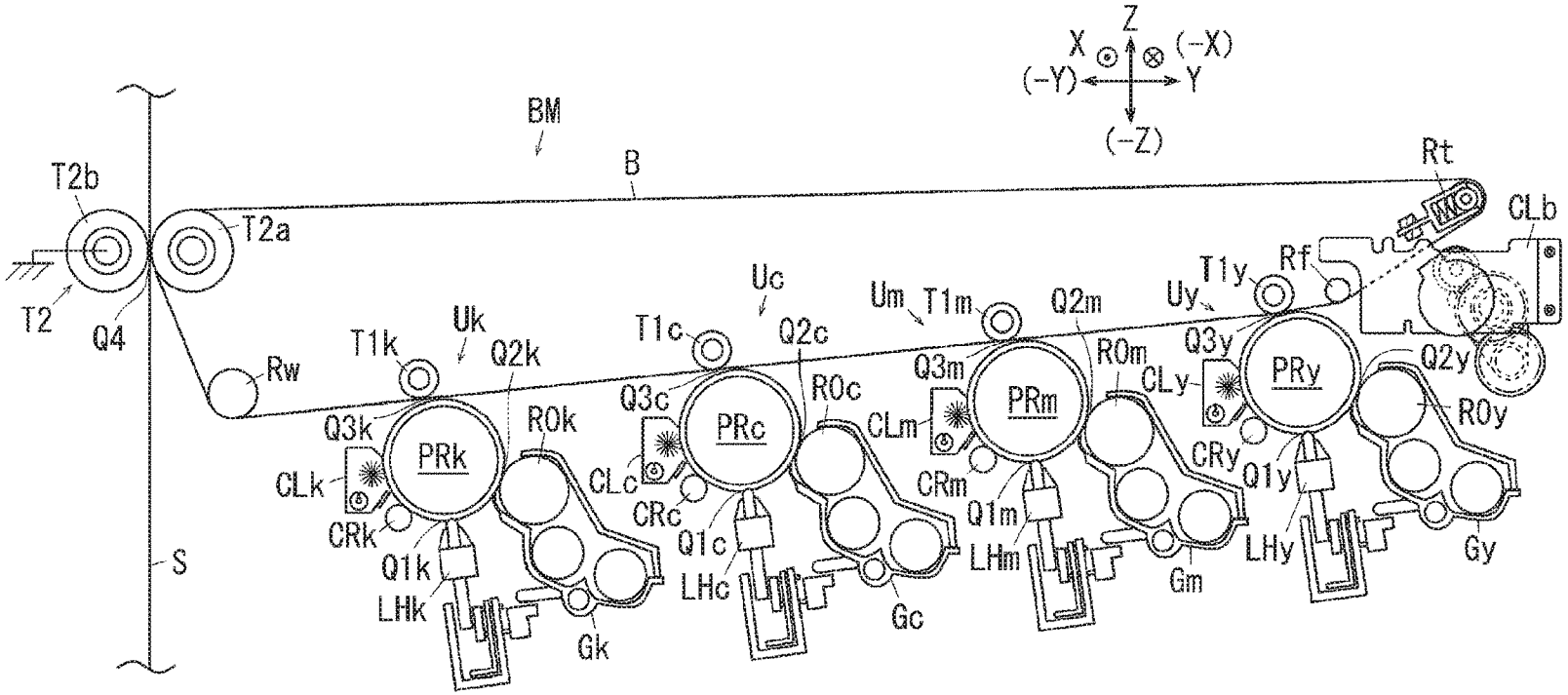
FIG. 2 is a partial view of the image forming apparatus according to the exemplary embodiment.

FIG. 2 is a partial view of the image forming apparatus according to the exemplary embodiment.

Referring to FIG. 1, a printer U, which is an example of an image forming apparatus according to the exemplary embodiment of the present invention, includes a printer body U1, which is an example of a recording unit and an example of an image forming unit. The printer body U1 includes a controller C that controls the printer U. The controller C is electrically connected to a personal computer COM, which is an example of information transmitting device. The controller C is capable of processing image information transmitted from the personal computer COM. The controller C is electrically connected to a writing circuit DL of the printer body U1. The writing circuit DL is electrically connected to LED heads LHy, LHm, LHc, and LHk, each of which is an example of a latent-image forming device and an example of an exposure device.

The LED heads LHy, LHm, LHc, and LHk according to the exemplary embodiment are disposed so as to correspond to yellow (Y), magenta (M), cyan (C), and black (K). The LED heads LHy to LHk according to the exemplary embodiment each include an LED array, which is an example of a light-emitting element an in which LEDs are arranged linearly in the width direction of an image. The LEDs of the LED heads LHy to LHk are capable of emitting light in accordance with an input signal. That is, the LED heads LHy to LHk are each capable of outputting a writing beam in accordance with an input signal.

Referring to FIG. 2, photoconductors PRy, PRm, PRc, and PRk, each of which is an example of an image carrier, are disposed above the LED heads LHy to LHk. The photoconductors PRy to PRk and the LED heads LHy to LHk face each other in writing regions Q1*y*, Q1*m*, Q1*c*, and Q1*k*.

Charging rollers CRy, CRm, CRc, and CRk, each of which is an example of a charger, are disposed upstream of the LED heads LHy to LHk in the rotation direction of the photoconductors PRy, PRm, PRc, and PRk. The charging rollers CRy to CRk according to the exemplary embodiment are supported so as to be rotatable in contact with the photoconductors PRy to PRk.

Developing devices Gy, Gm, Gc, and Gk are disposed downstream of the LED heads LHy to LHk in the rotation direction of the photoconductors PRy to PRk. The photoconductors PRy to PRk and the developing devices Gy to Gk face each other in developing regions Q2*y*, Q2*m*, Q2*c*, and Q2*k*.

First-transfer rollers T1*y*, T1*m*, T1*c*, and T1*k*, each of which is an example of a first-transfer unit, are disposed downstream of the developing devices Gy to Gk in the rotation direction of the photoconductors PRy to PRk. The photoconductors PRy to PRk and the first-transfer rollers T1*y* to T1*k* face each other in the first-transfer regions Q3*y*, Q3*m*, Q3*c*, and Q3*k*.

Photoconductor cleaners CLy, CLm, CLc, and CLk, each of which is an example of an image carrier cleaner, are disposed downstream of the first-transfer rollers T1*y* to T1*k* in the rotation direction of the photoconductors PRy to PRk.

The photoconductor PRy, the charging roller CRy, the LED head LHy, the developing device Gy, the first-transfer roller T1*y*, the photoconductor cleaner CLy, each for the color Y, constitute an image-forming unit Uy for the color Y according to the exemplary embodiment. The image-forming unit Uy is an example of a yellow-visible-image forming device according to the exemplary embodiment, which forms a toner image as an example of a visible image. Likewise, the photoconductors PRm, PRc, and PRk; the charging roller CRm, CRc, and CRk; the LED heads LHm, LHc, and LHk; the developing devices Gm, Gc, and Gk; the first-transfer rollers T1*m*, T1*c*, and T1*k*; and the photoconductor cleaners CLm, CLc, and CLk respectively constitute image-forming units Um, Uc, and Uk for the colors M, C, and K.

A belt module BM, which is an example of an intermediate transfer device, is disposed above the photoconductors PRy to PRk. The belt module BM includes an intermediate transfer belt B, which is an example of an image carrier and an example of an intermediate transfer body. The intermediate transfer belt B is an endless-belt-shaped member.

The intermediate transfer belt B according to the exemplary embodiment is rotatably supported by a tension roller Rt, which is an example of a tension member; a walking roller Rw, which is an example of a deviation correction member; an idler roller Rf, which is an example of a driven member; a backup roller T2*a*, which is an example of a second-transfer-region facing member and an example of a drive member; and the first-transfer rollers T1*y*, T1*m*, T1*c*, and T1*k*.

A second-transfer roller T2*b*, which is an example of a second-transfer member, is disposed so as to face the backup roller T2*a* with the intermediate transfer belt B therebetween. In the exemplary embodiment, the power circuit E applies a second-transfer voltage, having the same polarity as the charged toner, to the backup roller T2*a*. The second-transfer roller T2*b* is grounded. The backup roller T2*a* and the second-transfer roller T2*b* constitute a second-transfer unit T2 according to the exemplary embodiment, which is an example of a transfer unit. The second-transfer roller T2*b* and the intermediate transfer belt B are in contact with each other in a second-transfer region Q4.

A belt cleaner CLb, which is an example of an intermediate-transfer-body cleaner, is disposed downstream of the second-transfer region Q4 in the rotation direction of the intermediate transfer belt B.

The first-transfer rollers T1*y* to T1*k*, the intermediate transfer belt B, the second-transfer unit T2, and the like constitute a transfer device T1+T2+B according to the exemplary embodiment.

Figure 3:
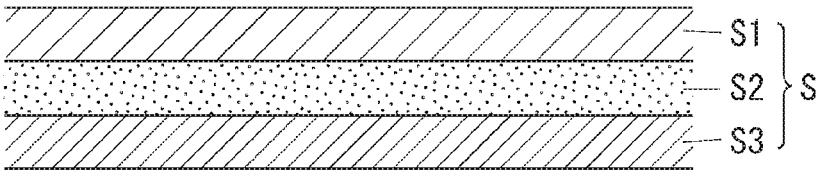
FIG. 3 illustrates a continuous sheet according to the exemplary embodiment.

FIG. 3 illustrates a continuous sheet according to the exemplary embodiment.

Referring to FIG. 1, a sheet feeding device U2, which is an example of a continuous medium supply unit, is disposed below the image-forming units Uy to Uk. The sheet feeding device U2 includes a sheet feeding member U2*a* around which a continuous sheet S, which is an example of a continuous medium, is wound. Referring to FIG. 3, the continuous sheet S according to the exemplary embodiment is a rolled label sheet including a base sheet S1 on which an image is to be printed, an adhesive S2 applied to the back surface of the base sheet S1, and a release sheet S3 to which the adhesive S2 is affixed. That is, the continuous sheet S according to the exemplary embodiment includes an intermediate layer of the adhesive S2, which is an example of an adhesive layer.

The sheet feeding member U2*a* is rotatably supported. A tension application unit U2*b*, which is an example of a tension application device, is disposed on the left side of the sheet feeding member U2*a*. The tension application unit U2*b* includes two driven rollers U2*c*, each of which is an example of a support member, for supporting the continuous sheet S. A dancer roller U2*d*, which is an example of a tension application member, is disposed between the driven rollers U2*c*. The dancer roller U2*d* is in contact with the continuous sheet S and supported so as to be movable in the up-down direction. The dancer roller U2*d* presses the continuous sheet S with gravity to apply a tension to the continuous sheet S, thereby preventing creasing of the continuous sheet S.

The continuous sheet S, which is supplied from the sheet feeding device U2, extends toward the second-transfer region Q4 of the printer body U1. A powder supply device Fk, which is an example of an adhesion-suppressing-agent supply unit, is disposed upstream of the second-transfer region Q4 in the transport direction of the continuous sheet S.

A fixing device F, which is an example of a fixing unit, is disposed downstream of second-transfer roller T2*b* in the transport direction of the continuous sheet S. The fixing device F includes a heating belt Fh, which is an example of a first fixing member and an example of a heating member, and a pressing roller Fp, which is an example of a second fixing member and an example of a pressing member. A heater, which is an example of a heat source, is contained in the heating belt Fh.

A guide roller Rb, which is an example of a guide member, is rotatably supported at a position downstream of the fixing device F.

A post-processing device U6 is disposed downstream of the guide roller Rb. The post-processing device U6 includes a cutting device U6*a*, which is an example of a removing unit. The cutting device U6*a* cuts off end portions of the continuous sheet S in the width direction of the continuous sheet S.

A lamination device U6*b*, which is an example of a lamination unit, is disposed downstream of the cutting device U6*a*. The lamination device U6*b* affixes a lamination material, which is an example of a protective member, to a surface of the continuous sheet S.

A guide roller Rb, which is an example of a guide member, is disposed downstream of the post-processing device U6.

A winding roller U4*a*, which is an example of a recovery member, is disposed downstream of the guide roller Rb. The continuous sheet S is wound around the winding roller U4*a*. The winding roller U4*a* is driven by a motor (not shown), which is an example of a drive source.

Description of Image Forming Operation

When receiving image information from the personal computer COM, the printer U according to the exemplary embodiment, having the structure described above, starts a printing operation. On the basis of the received image information, the controller C causes the printer U to generate image information for forming latent images of yellow Y, magenta M, cyan C, and black K. The controller C outputs the generated image information to the writing circuit DL of the printer body U1. If the image is a monochrome image, the controller C outputs the image information for forming only a black (K) image to the writing circuit DL.

The writing circuit DL outputs control signals to the LED heads LHy to LHk in accordance with the input image information. The LED heads LHy to LHk output writing beams in accordance with the control signals.

The photoconductors PRy to PRk are rotated when the image forming operation is started. The power circuit E applies a charging voltage to the charging rollers CRy to CRk. Accordingly, the surfaces of the photoconductors PRy to PRk are charged by the charging rollers CRy to CRk. In the writing regions Qty to Q1*k*, electrostatic latent images are formed on the surfaces of the photoconductors PRy to PRk as the LED heads LHy to LHk emit writing beams to the surfaces. In the developing regions Q2*y* to Q2*k*, the developing devices Gy, Gm, Gc, and Gk develop the electrostatic latent images on the photoconductors PRy to PRk into toner images, each of which is an example of a visible image.

The developed toner images are transported to the first-transfer regions Q3*y*, Q3*m*, Q3*c*, and Q3*k*, in which the photoconductors PRy to PRk are in contact with the intermediate transfer belt B. In the first-transfer regions Q3*y*, Q3*m*, Q3*c*, and Q3*k*, the power circuit E applies a first-transfer voltage, which has a polarity opposite to the charging polarity of the toner, to the first-transfer rollers T1*y* to T1*k*. Accordingly, the first-transfer rollers T1*y* to T1*k* transfer the toner images on the photoconductors PRy to PRk to the intermediate transfer belt B. When transferring multiple-color toner images to the intermediate transfer belt B, the toner images are transferred in such a way that a toner image is transferred in a downstream first-transfer region so as to overlap a toner image that has been transferred in an upstream first-transfer region.

The photoconductor cleaners CLy to CLk clean the surfaces of the photoconductors PRy to PRk by removing substances that remain on or adhere to the surfaces after first-transfer has been finished. The charging rollers CRy to CRk charge the cleaned surfaces of the photoconductors PRy to PRk again.

The monochrome or multiple-color toner images, which have been transferred by the first-transfer rollers T1*y* to T1*k* onto the intermediate transfer belt B in the first-transfer regions Q3*y* to Q3*k*, are transported to the second-transfer region Q4.

The continuous sheet S is transported downstream by receiving a transport force in the second-transfer region Q4, in the fixing device F, and from the winding roller U4*a*. When the continuous sheet S is transported downstream and the dancer roller U2*d* rises to a predetermined upper limit position, the sheet feeding member U2*a* is driven for a predetermined period. Accordingly, the continuous sheet S is dispensed from the sheet feeding member U2*a*, and the dancer roller U2*d* descends.

The powder supply device Fk applies powder to both end portions of the continuous sheet S in the width direction at a position upstream of the second-transfer region Q4, thereby preventing adherence of the adhesive S2 to members inside the printer U.

The power circuit E applies a second-transfer voltage, which has the same polarity as the charged toner, to the backup roller T2*a*. Accordingly, the toner images on the intermediate transfer belt B are transferred to the continuous sheet S, which passes through the second-transfer region Q4.

The belt cleaner CLb removes substances adhering to the surface of the intermediate transfer belt B after the second transfer.

When the continuous sheet S, to which toner images have been second-transferred, passes through a fixing region Q5, in which the heating belt Fh and the pressing roller Fp are in contact with each other, the toner images are heated and fixed to the continuous sheet S.

The continuous sheet S, to which the image has been fixed, is transported to the post-processing device U6. In the post-processing device U6, the cutting device U6*a* cuts off end portions of the continuous sheet S in the width direction. Thus, the end portions, to which powder adheres, are removed from the continuous sheet S. The continuous sheet S, which has passed through the cutting device U6*a*, is transported to the lamination device U6*b*. The lamination device U6*b* affixes the lamination material to the surface of the continuous sheet S.

The continuous sheet S, which has passed through the post-processing device U6, is wound around the winding roller U4*a*.

Description of Fixing Device F

Figure 4:
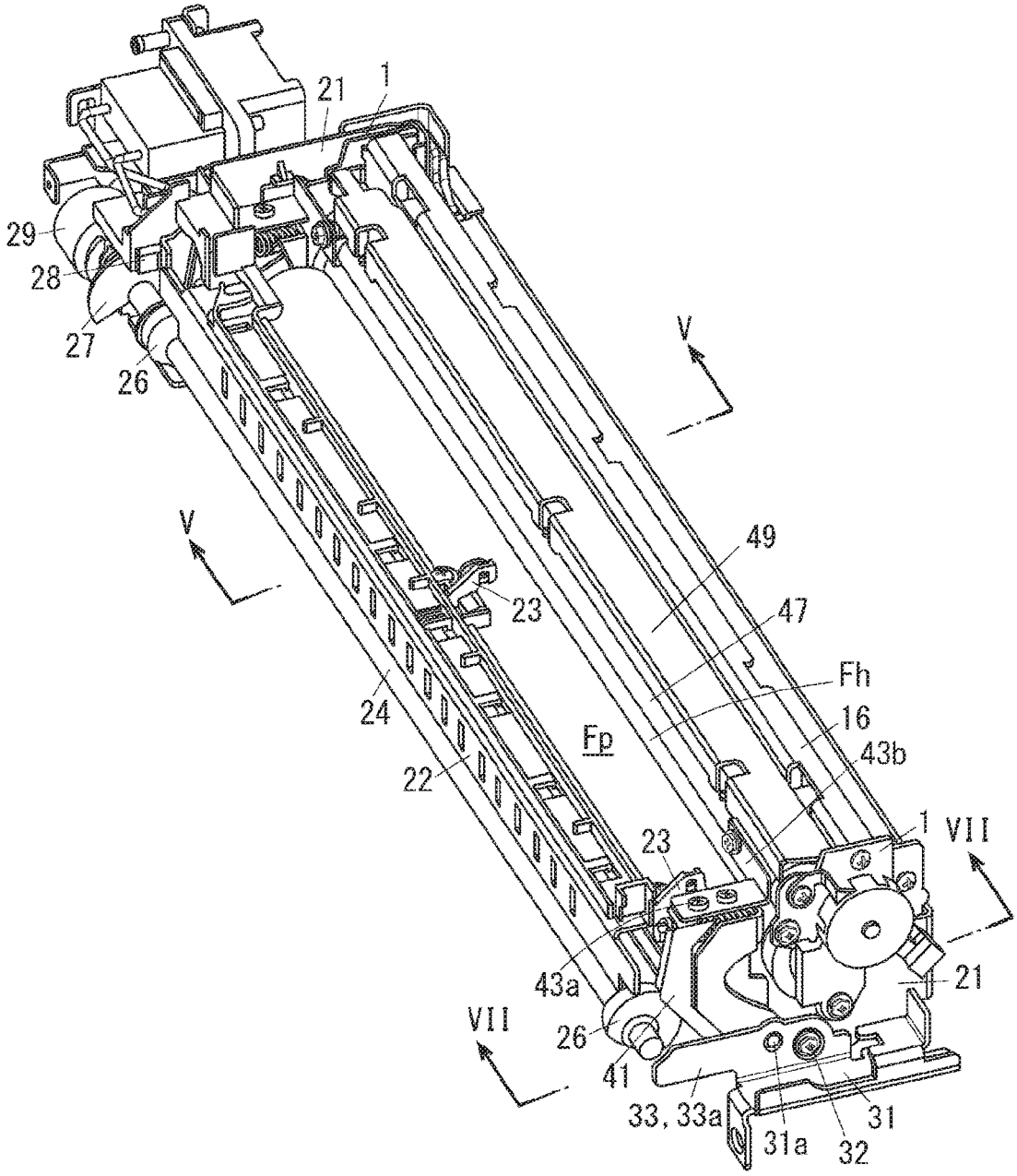
FIG. 4 is a perspective view of a fixing device according to the exemplary embodiment in a state in which a pressing roller is at a contact position.

FIG. 4 is a perspective view of a fixing device according to the exemplary embodiment in a state in which a pressing roller is at a contact position.

Figure 5A:
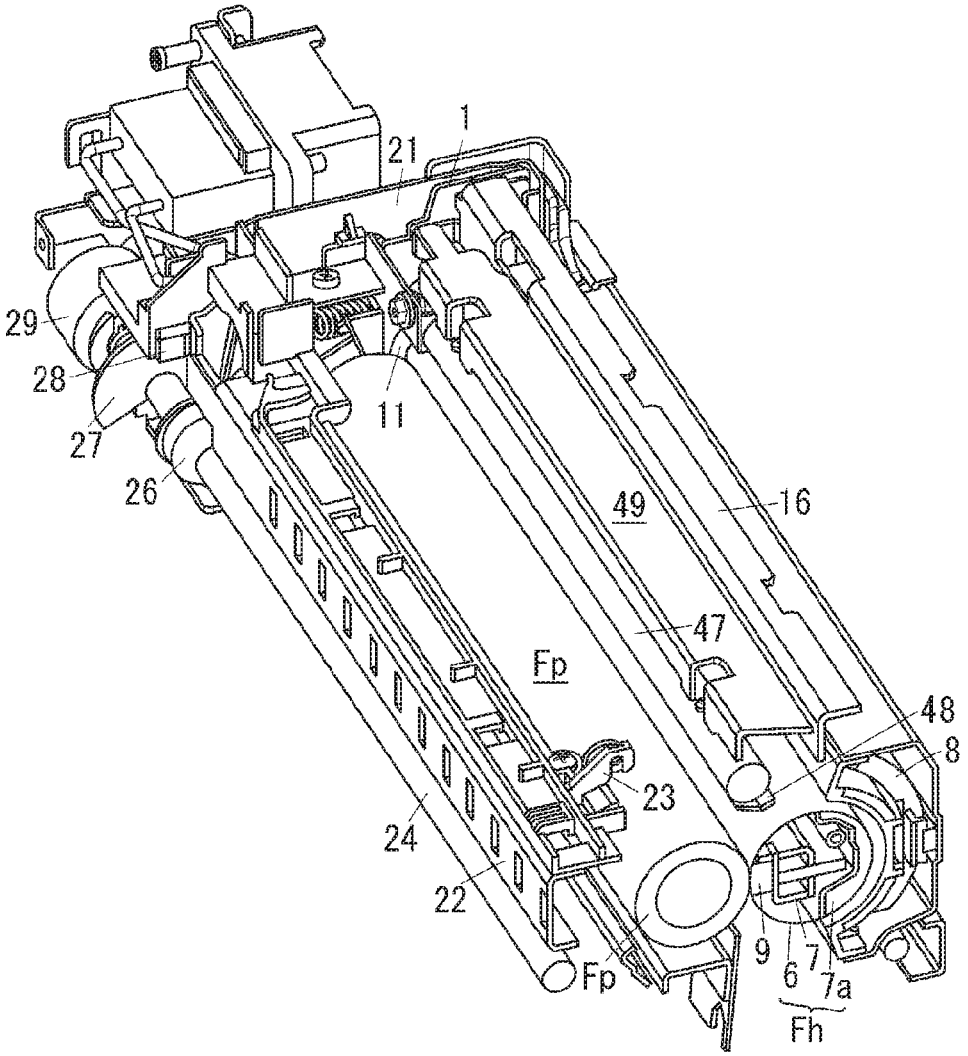
FIG. 5A is a perspective sectional view of the fixing device according to the exemplary embodiment taken along line V-V of FIG. 4.
Figure 5B:
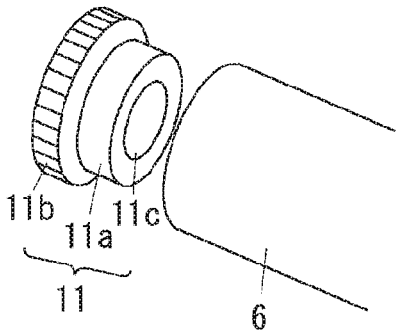
FIG. 5B illustrates a gear portion of a heating belt of the fixing device.

FIG. 5A is a perspective sectional view of the fixing device according to the exemplary embodiment taken along line V-V of FIG. 4, and FIG. 5B illustrates a gear portion of a heating belt of the fixing device.

Figure 6:
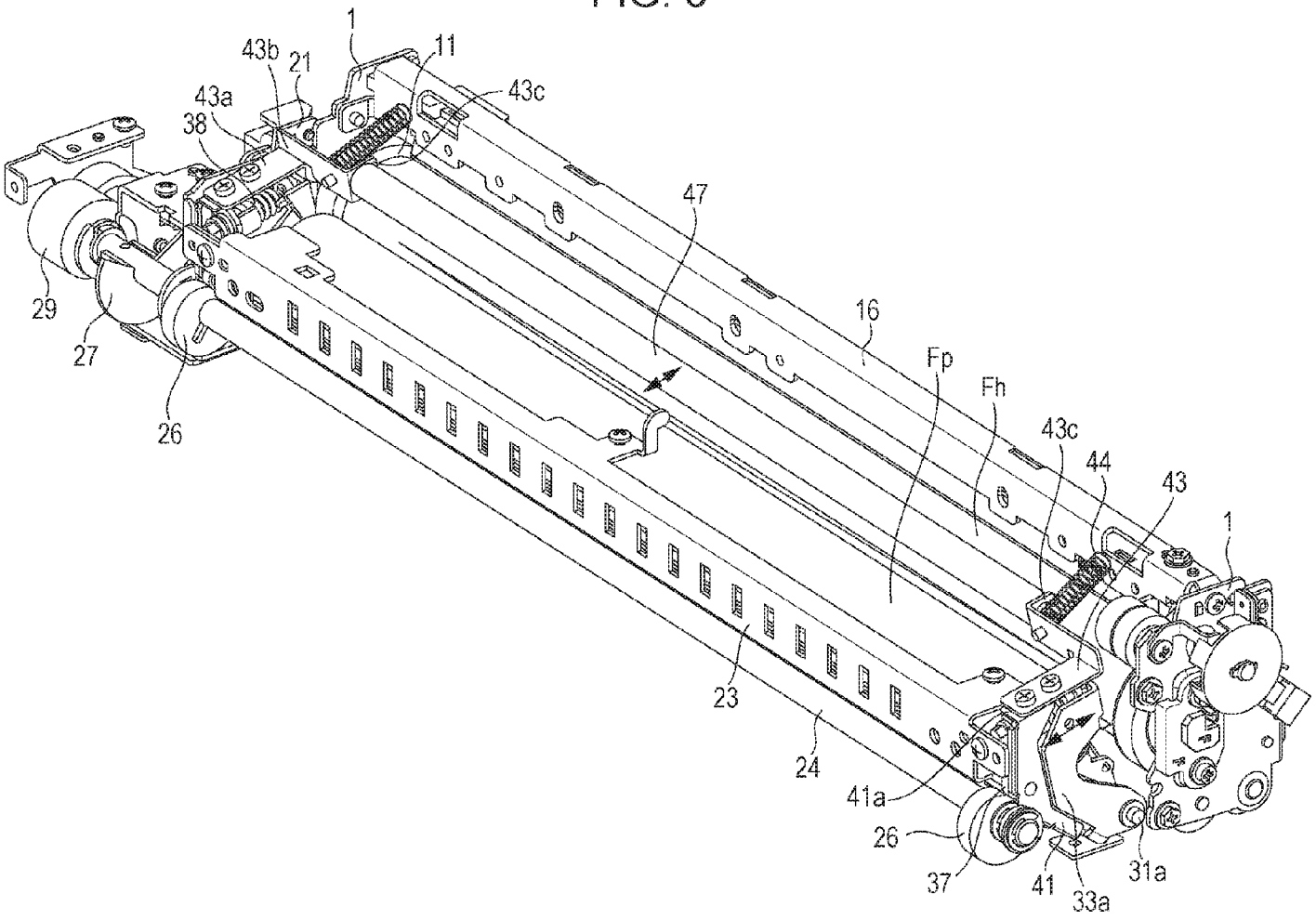
FIG. 6 is a partial view of the fixing device according to the exemplary embodiment in a state in which the pressing roller is at a separation position and a part of a support body, a motor, a safety cover, a spring, and the like are omitted.

FIG. 6 is a partial view of the fixing device according to the exemplary embodiment in a state in which the pressing roller is at a separation position and a part of a support body, a motor, a safety cover, a spring, and the like are omitted.

Figure 7:
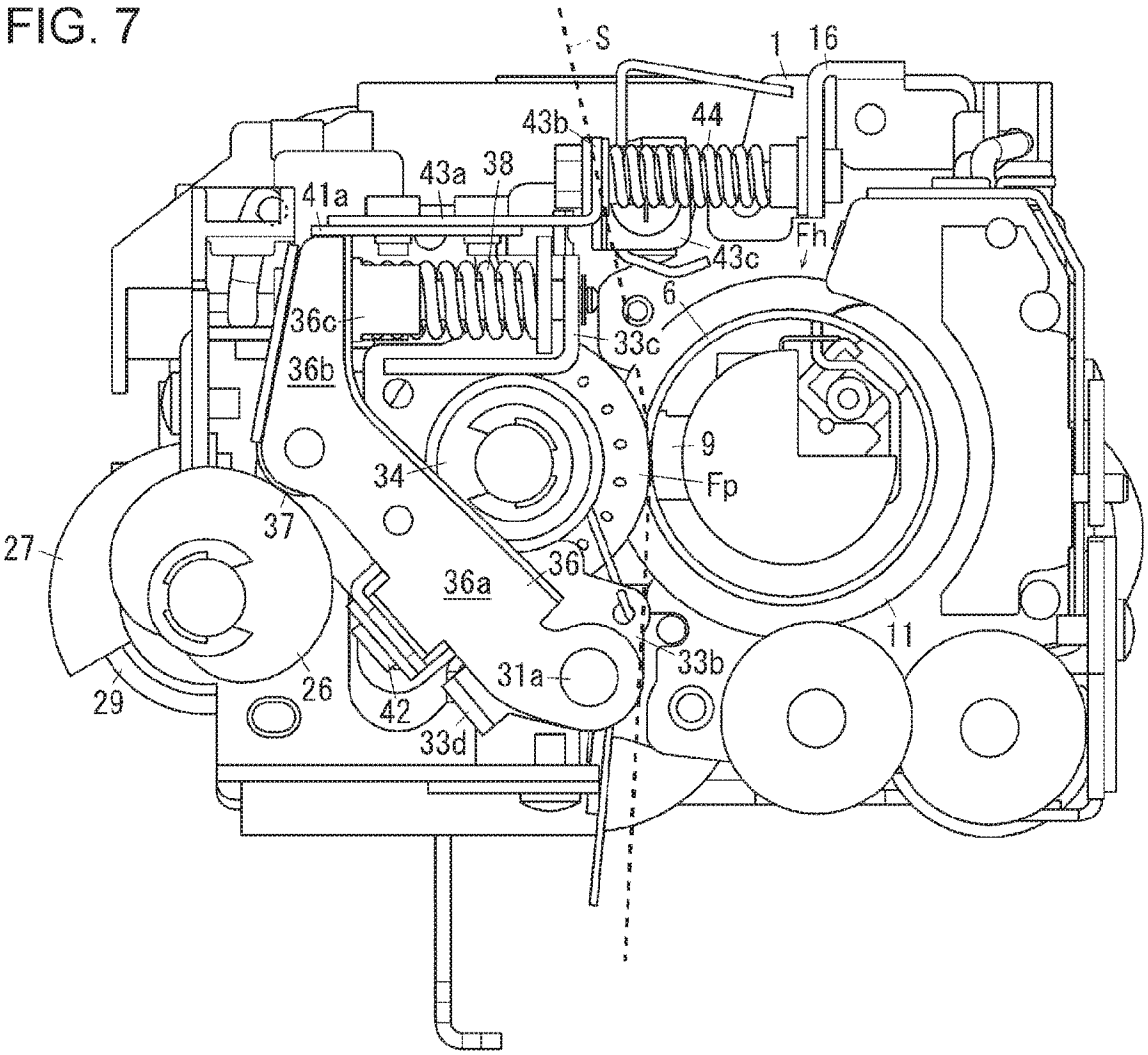
FIG. 7 is a sectional view taken along line VII-VII of FIG. 4.

FIG. 7 is a sectional view taken along line VII-VII of FIG. 4.

Referring to FIGS. 4 to 6, the fixing device F according to the exemplary embodiment includes a pair of front and back support walls 1, each of which is an example of a support body. The support walls 1 rotatably support the heating belt Fh via bearing members (not shown).

Referring to FIGS. 5A, 5B, and 7, the heating belt Fh includes a belt body 6 having an endless shape, which is an example of a belt-shaped member. A frame portion 7, which is an example of a frame member, is contained in the belt body 6. The frame portion 7 is formed by bending plural plates, which extend in the front-back direction, and welding the plates together. The frame portion 7 includes a temperature-sensitive magnetic member 7*a* that is semiarc-shaped and that is disposed at a position opposite to the fixing region Q5. A pressing pad 9, which is an example of an elastic member, is supported by the frame portion 7 at a position corresponding to the fixing region Q5. The pressing pad 9 is in contact with the inner surface of the belt body 6 and applies a tension to the belt body 6. The pressing pad 9 keeps the shape of the fixing region Q5 in which the pressing roller Fp is in contact with the belt body 6, that is, keeps the transport path of the continuous sheet S to be in a predetermined state.

An induction heater 8 is disposed on the outer right side of the belt body 6. The temperature-sensitive magnetic member 7*a* has ferromagnetism in a temperature range below the Curie temperature. In this temperature range, the temperature-sensitive magnetic member 7*a* induces magnetic flux, which is generated by the induction heater 8 and has passed through the belt body 6, thereinto and generates a magnetic path extending through the inside the temperature-sensitive magnetic member 7*a*. Referring to FIG. 5B, a gear member 11, which is an example of a gear member, is supported at the back end of the belt body 6. The gear member 11 includes a small-diameter portion 11*a*, which supports the inner surface of the belt body 6. A gear portion 11*b*, which is an example of a gear portion, is integrally formed with a back part of the small-diameter portion 11*a*. Gear teeth are formed on the outer peripheral surface of the gear portion 11*b*. An opening 11*c*, through which the frame portion 7 extends in the front-back direction, is formed in a central part of the gear member 11. In the heating belt Fh, the frame portion 7, the induction heater 8, and the pressing pad 9 are unrotatably supported by the support walls 1; and the belt body 6 is rotatably supported by the pressing pad 9 and the small-diameter portion 11*a*.

Detailed description of the heating belt Fh will be omitted, because a heating belt of this type is described, for example, in Japanese Unexamined Patent Application Publication No. 2011-22473.

Referring to FIGS. 4 and 6, a right connection member 16, which extends in the front-back direction, is supported by right upper parts of the pair of front and back support walls 1. Cover members 21, each of which is an example of an outer frame member, are immovably supported outside of the pair of front and back support walls 1 in the front-back direction. In FIGS. 4 and 6, only one of the cover members 21 on the back side is shown, because other members would be hidden if the other cover member 21 on the front side were shown. A left cover member 22, which extends in the front-back direction, is disposed at the left ends of the cover members 21.

A cam shaft 24, which is an example of a rotary shaft and which extends in the front-back direction, is supported at a position on the left side and below the left cover member 22. The cam shaft 24 is rotatably supported by the cover members 21 at the front and back ends. Eccentric cams 26, each of which is an example of a movement member, are supported by the cam shaft 24. In the exemplary embodiment, a pair of front and back eccentric cams 26 are disposed. A detection plate 27, which is an example of a detected member, is supported at a back end portion of the cam shaft 24. The detection plate 27 has a disk-like shape a part of which is cut out so as to correspond to a position on the eccentric cam 26 where the diameter of the eccentric cam 26 is the smallest. An optical sensor 28, which is an example of a detection member, is disposed above the detection plate 27. The optical sensor 28 is supported by the cover member 21 on the back side. The optical sensor 28 is capable of detecting the rotation position of the eccentric cam 26 by detecting the detection plate 27 or the cutout portion of the detection plate 27. A cam gear 29, which is an example of a gear member, is supported at the back end of the cam shaft 24. Mechanical power is transmitted to the cam gear 29 from a motor (not shown), which is an example of a drive source and which is disposed in the printer body U1.

Referring to FIGS. 4 and 6, connection plates 31, each of which is an example of a connection member, are fixed to lower ends of the pair of front and back support walls 1 by using screws 32. The connection plates 31, first movable arms 33 (described below), and the like are symmetrically disposed in pairs in a front part and a back part of the fixing device F. Therefore, only the connection plate 31 and the like on the front side will be described, and detailed descriptions of the connection plate 31 and the like on the back side will be omitted.

The first movable arm 33, which is an example of a first movable member, is supported by the connection plate 31. The first movable arm 33 is rotatably supported by the connection plate 31 so as to be rotatable around a rotation center 31*a*, which is located in a right lower part of the first movable arm 33. Referring to FIGS. 4, 6, and 7, the first movable arm 33 includes a pair of front and back curved portions 33*a* and 33*b*. The curved portions 33*a* and 33*b* each have a C-shape that is open toward the fixing region Q5 so as to surround a rotary shaft 34 of the pressing roller Fp. The back curved portion 33*b* rotatably supports the rotary shaft 34 of the pressing roller Fp at a C-shaped middle portion thereof. The front curved portion 33*a* and the back curved portion 33*b* are connected at connection portions 33*c* and 33*d*, which are respectively disposed in a right upper part and a left lower part and which extend in the front-back direction.

Referring to FIG. 7, a second movable arm 36, which is an example of a second movable member, is supported between the front curved portion 33*a* and the back curved portion 33*b*. The second movable arm 36 is rotatably supported by the connection plate 31 so as to be rotatable around the rotation center 31*a*. The second movable arm 36 is rotatable independently from the first movable arm 33. The second movable arm 36 includes a lower portion 36*a*, which extends leftward and upward from the rotation center 31*a*, and an upper portion 36*b*, which extends upward from the left upper end of the lower portion 36*a*. A cam follower 37, which is an example of a moved portion, is supported at an upper end of the lower portion 36*a*. The cam follower 37 is shaped like a roller and rotatably supported by the second movable arm 36. The cam follower 37 is held in contact with the outer peripheral surface of the eccentric cam 26.

A spring support portion 36*c*, which is an example of an urging member support portion, is formed on the left side surface of the upper portion 36*b*. The spring support portion 36*c* is disposed so as to face the connection portion 33*c* of the first movable arm 33. A coil spring 38, which is an example of an urging member, is supported between the spring support portion 36*c* and the connection portion 33*c*. The coil spring 38 presses the first movable arm 33 rightward, thereby applying a force to the pressing roller Fp, which is supported by the first movable arm 33, so as to press the pressing roller Fp against the heating belt Fh. Therefore, the elastic force of the coil spring 38 is set beforehand in accordance with the fixing pressure of the pressing roller Fp.

Referring to FIGS. 4 and 6, a third movable arm 41, which is an example of a third movable member, is supported by the second movable arm 36. Referring to FIG. 7, the third movable arm 41 is fixed to and supported by a left lower part of the lower portion 36*a* of the second movable arm 36 with a screw 42. The third movable arm 41 has a plate-like shape that extends along the left side of the first movable arm 33 and that covers the front side of the second movable arm 36. An attachment portion 41*a*, which is bent backward, is formed at the upper end of the third movable arm 41.

Referring to FIGS. 4, 6, and 7, a guide attachment member 43 is supported by the attachment portion 41*a* of the third movable arm 41. Referring to FIG. 6, the guide attachment member 43 includes an attached portion 43*a*, which is fixed to the attachment portion 41*a* with screws. The attached portion 43*a* has a plate-like shape extending rightward and upward along an upper part the coil spring 38. An urging member support portion 43*b*, which extends inward in the front-back direction, is formed at the right upper end of the attached portion 43*a*. A guide attachment portion 43*c*, which extends rightward, is formed at an inner end of the urging member support portion 43*b*.

A coil spring 44, which is an example of an urging member, is supported between the urging member support portion 43*b* and the left side surface of the right connection member 16. The coil spring 44 urges the third movable arm 41; the second movable arm 36, to which the third movable arm 41 is fixed; the first movable arm 33, which is indirectly connected to the second movable arm 36 via the coil spring 38; and the pressing roller Fp, which is supported by the first movable arm 33, in a direction away from the heating belt Fh.

Figure 8B:
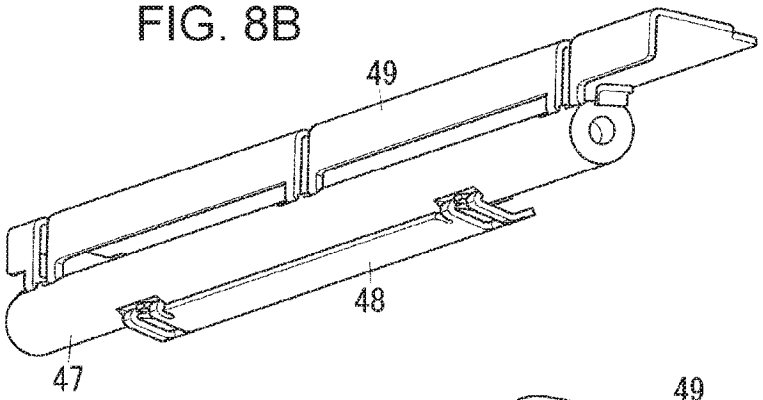
FIG. 8B is a view of the guide member seen in the direction of arrow VIIIB of FIG. 8A.
Figure 8C:
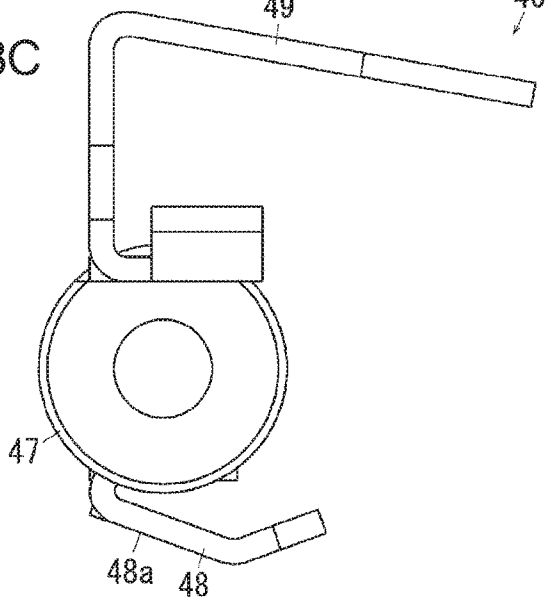
FIG. 8C is a view of the guide member seen in the direction of arrow VIIIC of FIG. 8A.
Figure 8A:
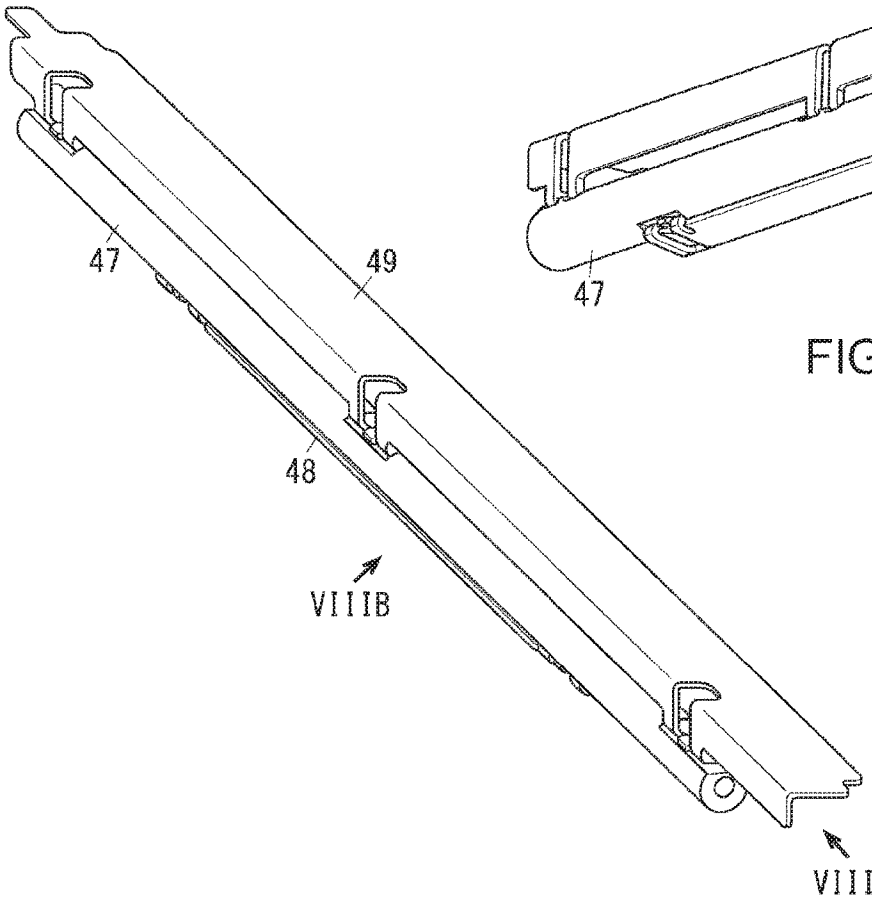
FIG. 8A is a perspective view of a guide member according to the exemplary embodiment.

FIG. 8A is a perspective view of a guide member according to the exemplary embodiment, FIG. 8B is a view of the guide member seen in the direction of arrow VIIIB of FIG. 8A, and FIG. 8C is a view of the guide member seen in the direction of arrow VIIIC of FIG. 8A.

A guide member 46, which is an example of a guide member, is supported by the guide attachment portion 43*c*. The guide member 46 includes a guide bar 47, which is an example of a separation member. The guide bar 47 has a bar-like shape extending in the front-back direction. The guide bar 47 is fixed to the pair of front and back guide attachment portions 43*c* with screws and supported by the guide attachment portions 43*c*. Referring to FIGS. 5A and 8, a sheet guide 48, which is an example of a guide portion, is supported on the lower surface of the guide bar 47. Referring to FIG. 8C, the sheet guide 48 has an inclined surface 48*a* that is inclined upward toward the left. Accordingly, the sheet guide 48 according to the exemplary embodiment is capable of guiding the leading end of the continuous sheet S toward the guide roller Rb along the inclined surface 48*a* when the continuous sheet S is autoloaded in the printer body U1. A safety cover 49, which is an example of cover member and an example of a protective member, is supported on the upper surface of the guide bar 47. The safety cover 49 has a plate-like shape that covers an upper part of the heating belt Fh. The safety cover 49 is disposed so that the right end thereof is adjacent to the left side surface of the right connection member 16.

In the exemplary embodiment, as with the pressing roller Fp, the second-transfer roller T2*b* is capable of contacting or separating from the backup roller T2*a*. A mechanism for causing the second-transfer roller T2*b* to contact or separate from the backup roller T2*a* may be similar to that of the mechanism for causing the pressing roller Fp to contact or separate from the heating belt Fh or may be any appropriate known mechanism. Therefore, detailed description of the mechanism will be omitted.

Functions of Fixing Device F

Figure 9:
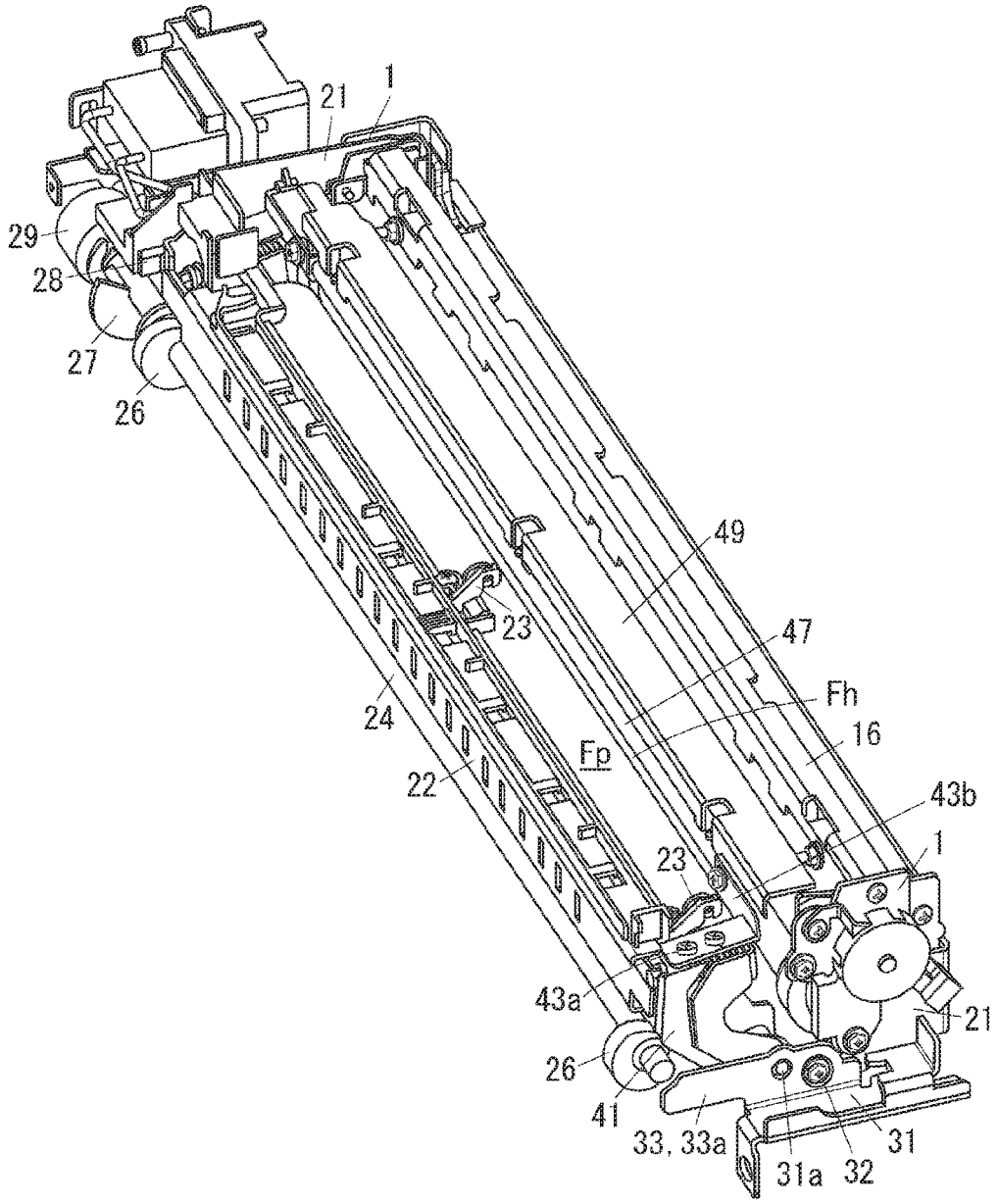
FIG. 9 is a perspective view of the fixing device according to the exemplary embodiment, corresponding to FIG. 4, in a state in which the pressing roller is at the separation position.

FIG. 9 is a perspective view of the fixing device according to the exemplary embodiment, corresponding to FIG. 4, in a state in which the pressing roller is at the separation position.

Figure 10:
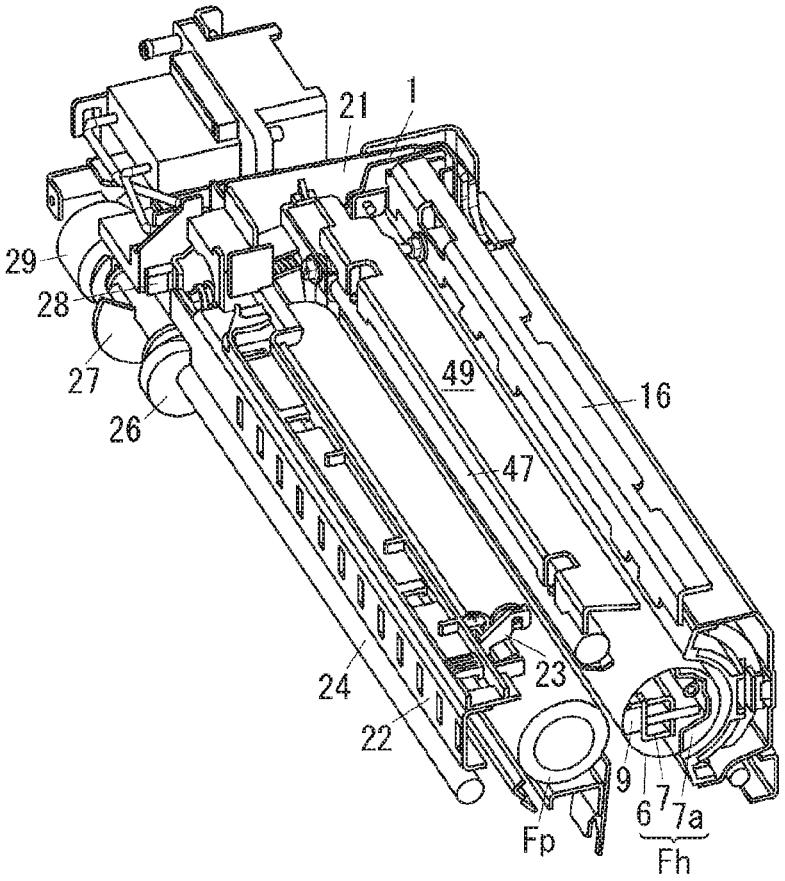
FIG. 10 is a perspective sectional view of the fixing device according to the exemplary embodiment, corresponding to FIG. 5A, in a state in which the pressing roller is at the separation position.

FIG. 10 is a perspective sectional view of the fixing device according to the exemplary embodiment, corresponding to FIG. 5A, in a state in which the pressing roller is at the separation position.

Figure 11:
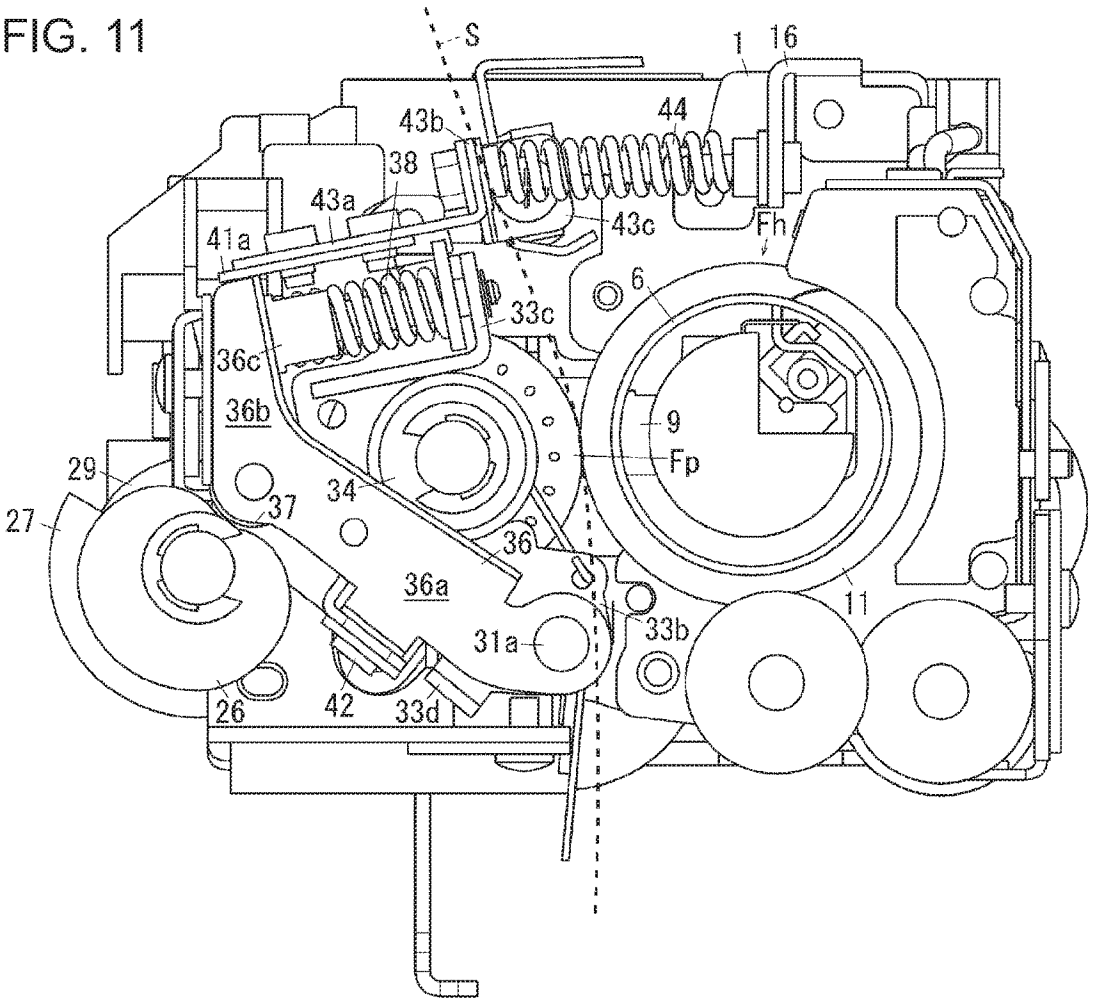
FIG. 11 is a sectional view of the fixing device according to the exemplary embodiment, corresponding to FIG. 7, in a state in which the pressing roller is at the separation position.

FIG. 11 is a sectional view of the fixing device according to the exemplary embodiment, corresponding to FIG. 7, in a state in which the pressing roller is at the separation position.

Referring to FIGS. 4 to 7, when an image forming operation is performed, in the fixing device F, the pressing roller Fp is kept at a contact position at which the pressing roller Fp is in contact with the heating belt Fh. At this time, the eccentric cam 26 is in contact with the cam follower 37 at a position at which the diameter of the eccentric cam 26 is the largest. Accordingly, the coil spring 44 contracts, and the movable arms 33, 36, and 41 move around the rotation center 31*a* toward the heating belt Fh. Thus, the pressing roller Fp contacts the heating belt Fh while being pressed by an elastic force of the coil spring 38. At this time, the guide bar 47 and the sheet guide 48 are separated from the continuous sheet S.

When the eccentric cam 26 rotates by 180 degrees from the state shown in FIGS. 4 to 7, the eccentric cam 26 enters a state shown in FIGS. 9 to 11. That is, a part of the outer surface of the eccentric cam 26 where the diameter of the eccentric cam 26 is small contacts the cam follower 37. Accordingly, as illustrated in FIGS. 9 to 11, the movable arms 33, 36, and 41 rotate leftward due to an elastic force of the coil spring 44. Thus, the pressing roller Fp, the guide bar 47, and the sheet guide 48 move leftward. Accordingly, the pressing roller Fp separates from the heating belt Fh. At this time, the guide bar 47 contacts the continuous sheet S and moves the continuous sheet S in a direction such that the continuous sheet S separates from the heating belt Fh.

Accordingly, motors that rotate the eccentric cam 26 and the cam shaft 24; the movable arms 33, 36, and 41; the coil spring 44; and the like constitute a movement mechanism 24 to 44 according to the exemplary embodiment, which causes the pressing roller Fp to contact or separate from the heating belt Fh. The movement mechanism 24 to 44 according to the exemplary embodiment includes the guide bar 47 and the like.

Description of Tension Application Unit U2*b*

Figure 12:
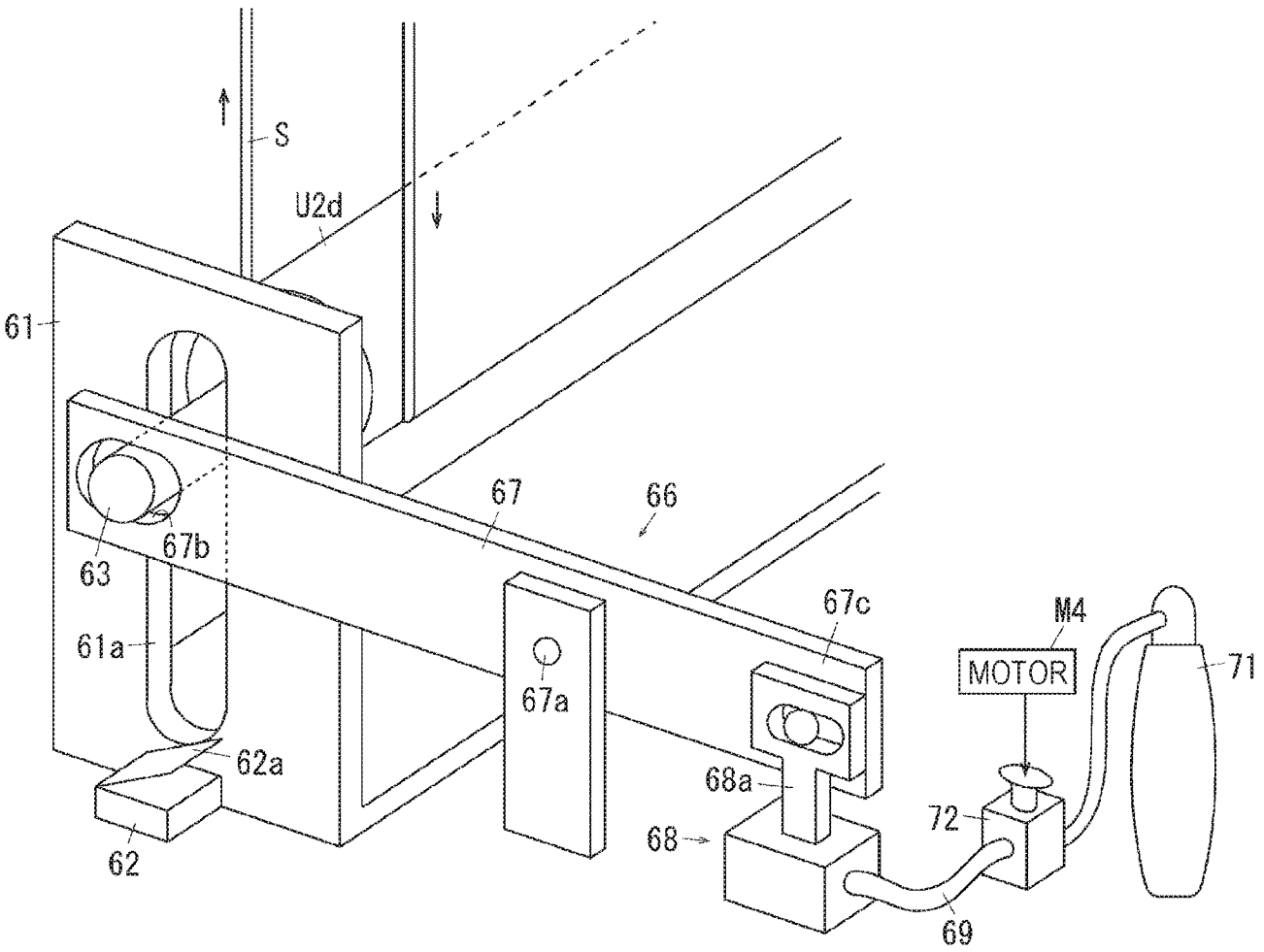
FIG. 12 illustrates a tension application mechanism of a sheet feeding device according to the exemplary embodiment.

FIG. 12 illustrates a tension application mechanism of a sheet feeding device according to the exemplary embodiment.

Referring to FIGS. 1 and 12, the tension application unit U2*b* according to the exemplary embodiment includes a guide plate 61, which is an example of a guide member, located outside the dancer roller U2*d*, which is an example of a contact member that contacts the continuous sheet S, in the axial direction. The guide plate 61 has a guide hole 61*a*, which is elongated in the up-down direction. A shaft 63 of the dancer roller U2*d* extends through the guide hole 61*a* and is supported in the guide hole 61*a*. Accordingly, the dancer roller U2*d* is supported so as to be movable in the up-down direction.

A microswitch 62, which is an example of a detection member, is supported at a position below the guide hole 61*a*. The microswitch 62 is disposed at such a position that a detection portion 62*a* thereof corresponds to the inside of the guide hole 61*a*. Accordingly, when the dancer roller U2*d* descends and the shaft 63 of the dancer roller U2*d* presses the detection portion 62*a*, it is possible for the microswitch 62 to detect that the dancer roller U2*d* has descended to a lower limit position.

A tension-addition device 66, which is an example of an application device, is connected to the shaft 63 of the dancer roller U2*d*, which is an example of a contact member. The tension-addition device 66 includes a lever 67, which is an example of an increase/decrease movement member. The lever 67 is supported so as to be rotatable around a rotation center 67*a*. A connection hole 67*b* is formed in one end portion of the lever 67. The connection hole 67*b* is elongated in the left-right direction. The shaft 63 of the dancer roller U2*d* extends through the connection hole 67*b* and is supported in the connection hole 67*b*. Accordingly, the lever 67 is rotatable so that the one end portion moves up and down as the dancer roller U2*d* moves up and down. A pneumatic jack 68, which is an example of a fluid-pressure movement member, is connected to the other end portion 67*c* of the lever 67. An air tank 71, which is an example of a fluid source, is connected to the pneumatic jack 68 through a hose 69. A valve 72, which is an example of a valve member, is supported at a middle portion of the hose 69. The valve 72 is configured to be opened and closed by a valve motor M4, which is an example of a drive source. In the exemplary embodiment, the valve 72 is configured to be opened to a first open position or a second open position and to be closed to a closed position. At the first open position, the air pressure of the pneumatic jack 68 is the atmospheric pressure. At the second open position, the pneumatic jack 68 and the air tank 71 are connected to each other. At the closed position, the air pressure of the pneumatic jack 68 is not the atmospheric pressure nor is the pneumatic jack 68 connected to the air tank. The pneumatic jack 68 is set so that a rod 68*a* moves upward when the air pressure increases. When the air pressure of the pneumatic jack 68 is at the atmospheric pressure, the lever 67 is freely rotatable.

The guide plates 61, the microswitches 62, and the tension-addition devices 66 are disposed in pairs in a front part and a back part of the fixing device F. FIG. 12 only illustrates such members on the front side. Illustrations and detailed descriptions of such members on the back side, which are symmetrical with those on the front side, will be omitted.

Description of Controller According to Exemplary Embodiment

Figure 13:
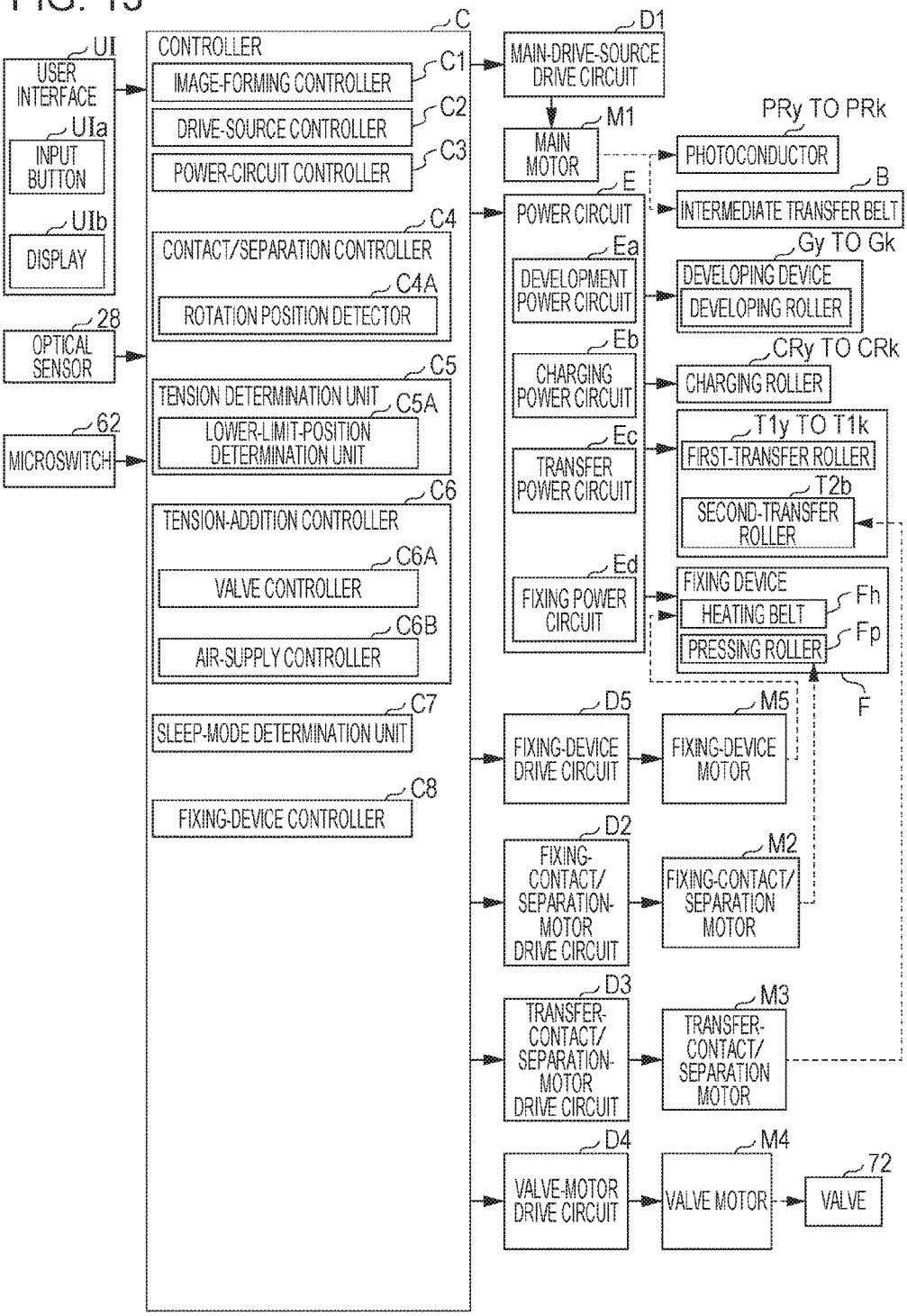
FIG. 13 is a block diagram illustrating functions of a controller of the image forming apparatus according to the exemplary embodiment.

FIG. 13 is a block diagram illustrating functions of a controller of the image forming apparatus according to the exemplary embodiment.

Referring to FIG. 13, the controller C of the printer U includes an I/O interface for inputting signals from or outputting signals to external devices. The controller C includes a read-only memory (ROM) that stores programs, information, and the like for performing necessary processing. The controller C includes a random-access memory (RAM) for temporarily storing necessary data. The controller C includes a central processing unit (CPU) that performs processing in accordance with programs stored in the ROM and the like. Accordingly, the controller C according to the exemplary embodiment is a small information processing device (microcomputer). Thus, the controller C is capable of performing various functions by executing programs stored in the ROM and the like.

Signal Output Elements Connected to Controller C

Output signals from signal output elements, such as a user interface UI, the optical sensor 28, and the microswitch 62, are input to the controller C.

The user interface UI includes an input button UIa, which is an example of an input member and which is an arrow button or the like. The user interface UI includes a display UIb, which is an example of a notification member, and the like.

The optical sensor 28 detects the cutout portion of the detection plate 27.

The microswitch 62 detects the dancer roller U2*d* that has moved to the lower limit position.

Controlled Elements Connected to Controller C

The controller C is connected to a main-drive-source drive circuit D1, a fixing-contact/separation-motor drive circuit D2, a transfer-contact/separation-motor drive circuit D3, a valve-motor drive circuit D4, a fixing-device drive circuit D5, a power circuit E, and other controlled elements (not shown). The controller C outputs control signals to the circuits D1 to D5, E, and the like.

D1: Main-Drive-Source Drive Circuit

The main-drive-source drive circuit D1 drives a main motor M1, which is an example of a main drive source, to rotate the photoconductors PRy to PRk, the intermediate transfer belt B, and the like.

D2: Fixing-Contact/Separation-Motor Drive Circuit

The fixing-contact/separation-motor drive circuit D2 drives the fixing-contact/separation motor M2 to rotate the eccentric cam 26 so that the pressing roller Fp and the heating belt Fh contact or separate from each other.

D3: Transfer-Contact/Separation-Motor Drive Circuit

The transfer-contact/separation-motor drive circuit D3 drives the transfer-contact/separation motor M3 to cause the second-transfer roller T2*b* and the intermediate transfer belt B to contact or separate from each other.

D4: Valve-Motor Drive Circuit

The valve-motor drive circuit D4 drives the valve motor M4 to open the valve 72 to the first open position or the second open position or to close the valve 72 to the closed position.

D5: Fixing-Device Drive Circuit

The fixing-device drive circuit D5 drives the fixing-device motor M5 to drive the heating belt Fh.

E: Power Circuit

The power circuit E includes a development power circuit Ea, a charging power circuit Eb, a transfer power circuit Ec, a fixing power circuit Ed, and the like.

Ea: Development Power Circuit

The development power circuit Ea applies a development voltage to the developing rollers of the developing devices Gy to Gk.

Eb: Charging Power Circuit

The charging power circuit Eb applies a charging voltage, for charging the surfaces of the photoconductors PRy to PRk, to the charging rollers CRy to CRk.

Ec: Transfer Power Circuit

The transfer power circuit Ec applies a transfer voltage to the first-transfer rollers T1*y* to T1*k* and the backup roller T2*a*.

Ed: Fixing Power Circuit

The fixing power circuit Ed supplies electric power to the induction heater 8 of the heating belt Fh of the fixing device F.

Functions of Controller C

The controller C has functions of performing processing in accordance with input signals from the signal output elements and outputting control signals to the controlled elements. That is, the controller C has the following functions.

C1: Image-Forming Controller

An image-forming controller C1 performs a job, which is an image forming operation, by controlling driving of members of the printer U and timings of applying voltages in accordance with image information input from the personal computer COM.

C2: Drive-Source Controller

A drive-source controller C2 controls driving of the main motor M1 via the main-drive-source drive circuit D1 and controls driving of the photoconductors PRy to PRk and the like.

C3: Power-Circuit Controller

A power-circuit controller C3 controls the power circuits Ea to Ed to control voltages applied to corresponding members and electric power supplied to the members.

C4: Contact/Separation Controller

A contact/separation controller C4 includes a rotation-position detector C4A. The contact/separation controller C4 controls the contact/separation motors M2 and M3 via the contact/separation-motor drive circuits D2 and D3 to control contact/separation of the pressing roller Fp and the heating belt Fh and contact/separation of the second-transfer roller T2*b* and the intermediate transfer belt B. When the job is performed, the contact/separation controller C4 according to the exemplary embodiment causes the pressing roller Fp and the second-transfer roller T2*b* to respectively contact the heating belt Fh and the intermediate transfer belt B. The continuous sheet S is not transported in the following cases: when the power is off; when the printer U is in a standby mode, in which the printer U is waiting for a job to be started; and when the printer U is in a sleep mode, in which the printer U is waiting for a job to be started in a state in which the power consumption is reduced. In such cases, the contact/separation controller C4 according to the exemplary embodiment separates the pressing roller Fp and the second-transfer roller T2*b* respectively from the heating belt Fh and the intermediate transfer belt B. In the exemplary embodiment, the printer U is in a stand-by mode for a predetermined period from the time when the power is turned on or a job finishes to the time when a predetermined time t1, before entering a sleep mode, elapses.

C4A: Rotation-Position Detector

The rotation-position detector C4A detects the rotation position of the eccentric cam 26 on the basis of the result of detection by the optical sensor 28.

C5: Tension Determination Unit

The tension determination unit C5 includes a lower-limit-position determination unit C5A. The tension determination unit C5 determines whether or not a tension is applied to the continuous sheet S. The tension determination unit C5 according to the exemplary embodiment determines whether or not a tension is applied to continuous sheet S if the heating belt Fh and the pressing roller Fp are separated from each other the heating belt Fh is to be driven. To be specific, the tension determination unit C5 according to the exemplary embodiment determines whether or not a tension is applied to the continuous sheet S before starting to rotate the heating belt Fh when increasing the temperature of the heating belt Fh while rotating the heating belt Fh in a stand-by mode. In the exemplary embodiment, if the microswitch 62 is detecting the dancer roller U2*d*, the dancer roller U2*d* is at the lower limit position, and therefore it is estimated that the continuous sheet S is loose and the tension of the continuous sheet S is insufficient. In this case, the tension determination unit C5 determines that a tension is not applied to the continuous sheet S.

C5A: Lower-Limit-Position Determination Unit

The lower-limit-position determination unit C5A determines whether or not the dancer roller U2*d* is at the lower limit position on the basis of the result of detection by the microswitch 62.

C6: Tension-Addition Controller

A tension-addition controller C6 includes a valve controller C6A and an air-supply controller C6B. When the continuous sheet S is not transported, the tension-addition controller C6 makes the tension of the continuous sheet S higher than that when the continuous sheet S is transported. That is, the tension-addition controller C6 additionally applies a tension to the continuous sheet S to which a tension is being applied. The tension-addition controller C6 according to the exemplary embodiment increases the air pressure of the pneumatic jack 68 to forcibly lower the dancer roller U2*d*. That is, the dancer roller U2*d* is moved in a direction such that the tension of the continuous sheet S increases. Thus, the tension of the continuous sheet S increases. Then, the tension-addition controller C6 closes the valve 72 to the closed position to keep the air pressure of the pneumatic jack 68 at a high-pressure. When a job is started and the continuous sheet S is transported, the valve 72 is opened to the first open position so that the air pressure of the pneumatic jack 68 becomes atmospheric pressure. Thus, the pneumatic jack 68 stops forcibly lowering the dancer roller U2*d*, and the tension of the continuous sheet S returns to a tension generated by the weight of the dancer roller U2*d*.

C6A: Valve Controller

The valve controller C6A controls the valve 72. When increasing the air pressure of the pneumatic jack 68 to a high pressure, the valve controller C6A according to the exemplary embodiment opens the valve 72 to the second open position. When keeping the air pressure of the pneumatic jack 68 at the high pressure, the valve controller C6A according to the exemplary embodiment closes the valve 72 to the closed position. When reducing the air pressure of the pneumatic jack 68 to the atmospheric pressure, the valve controller C6A according to the exemplary embodiment opens the valve 72 to the first open position.

C6B: Air-Supply Controller

The air-supply controller C6B controls supply of air from the air tank 71 to the pneumatic jack 68. When increasing the air pressure of the pneumatic jack 68 to a high pressure, the air-supply controller C6B according to the exemplary embodiment causes air to be supplied to the pneumatic jack 68 in a state in which the valve 72 is opened to the second open position.

C7: Sleep-Mode Determination Unit

A sleep-mode determination unit C7 determines whether or not the printer U should enter a sleep mode. The sleep-mode determination unit C7 according to the exemplary embodiment determines that the printer U should enter a sleep mode if the predetermined time t1, before entering the sleep mode, elapses in a stand-by mode without a job being started.

C8: Fixing-Device Controller

A fixing-device controller C8 drives the fixing device F via the fixing-device drive circuit D5 when a tension is applied to the continuous sheet S. The fixing-device controller C8 according to the exemplary embodiment drives the heating belt Fh of the fixing device F if the dancer roller U2*d* is not at the lower limit position, in which case it is determined that a tension is applied to the continuous sheet S. The fixing-device controller C8 according to the exemplary embodiment keeps the fixing device F stopped if the tension determination unit C5 determines that a tension is not applied to the continuous sheet S when the continuous sheet S is not transported, that is, when the printer U is in a stand-by mode or in a sleep mode. That is, the fixing device F is not driven (is forcibly stopped). When the tension determination unit C5 determines that the tension of the continuous sheet S has decreased while the continuous sheet is transported, for example, when the dancer roller U2*d* moves to the lower limit position while a job is being performed, the fixing-device controller C8 according to the exemplary embodiment forcibly stops driving the fixing device F.

Description of Flowchart According to Exemplary Embodiment

Next, a control process performed by the printer U according to the exemplary embodiment will be described by using a flowchart.

Figure 14:
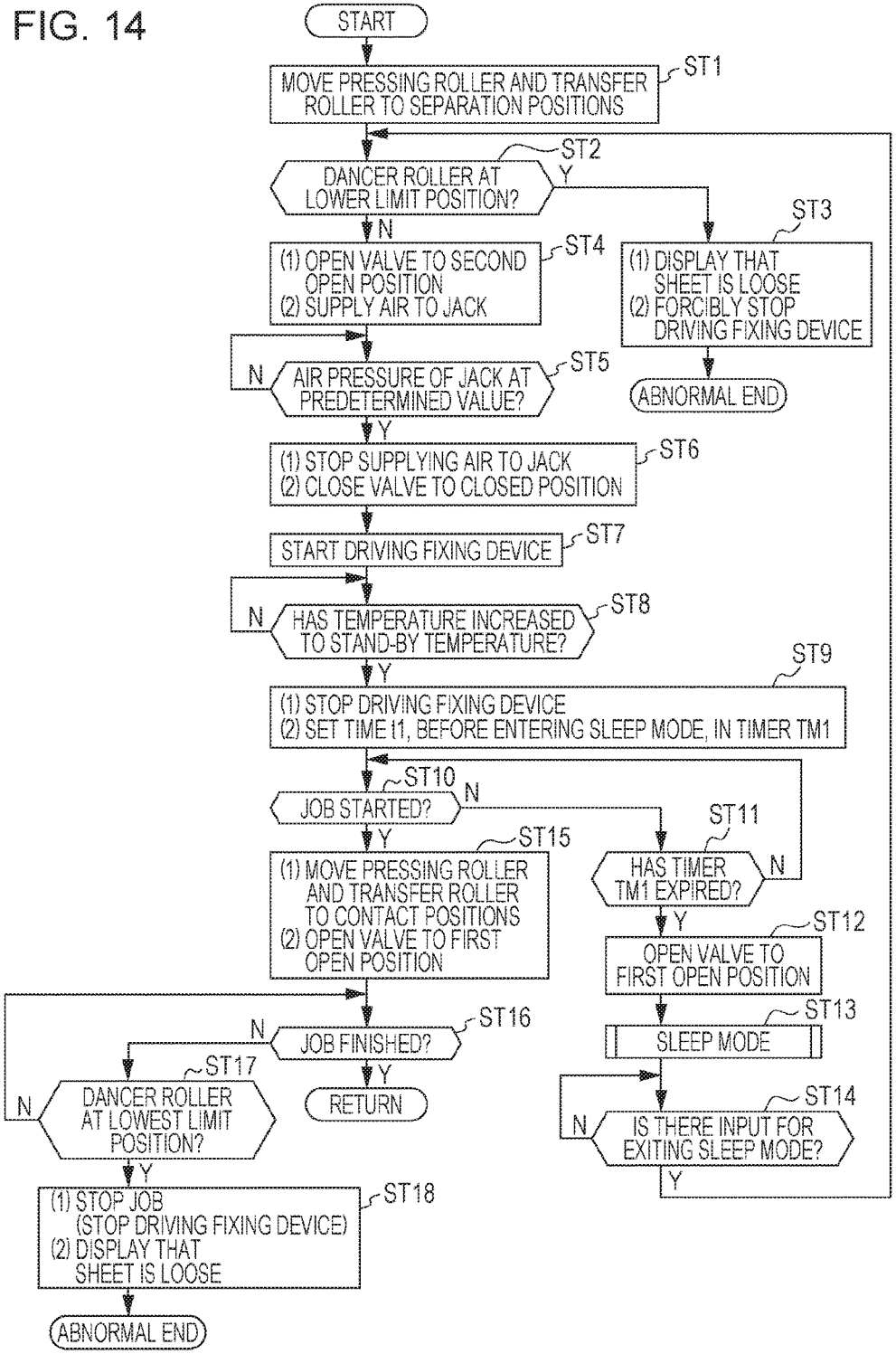
FIG. 14 is a flowchart of a process for controlling the tension of a continuous sheet and the fixing device according to the exemplary embodiment.

Description of Flowchart of Process of Controlling Tension of Continuous Sheet and Fixing Device FIG. 14 is a flowchart of a process for controlling the tension of a continuous sheet and the fixing device according to the exemplary embodiment.

The steps of the process shown in FIG. 14 are performed in accordance with a program stored in the controller C of the printer U. This process is performed concurrently with other processes of the printer U.

The process shown in the flowchart of FIG. 14 is started when the power of the printer U is turned on.

Referring to FIG. 14, in step ST1, the pressing roller Fp and the second-transfer roller T2*b* are moved to separation positions. If it is detected by the optical sensor 28 that the pressing roller Fp and the second-transfer roller T2*b* are already at the separation positions, they are kept at the separation positions. Then, the process proceeds to step ST2.

In step ST2, whether or not the dancer roller U2*d* is at the lower limit position is determined. If yes (Y), the process proceeds to step ST3. If no (N), the process proceeds to step ST4.

In step ST3, the following operations (1) and (2) are performed, and the process ends abnormally.

(1) Display on the display UIb that the continuous sheet S is loose.

(2) Forcibly stop driving the fixing device F.

In step ST4, the following operations (1) and (2) are performed, and the process proceeds to step ST5.

(1) Open the valve 72 to the second open position.

(2) Supply air to the pneumatic jack 68.

In step ST5, whether or not the air pressure of the pneumatic jack 68 has become a predetermined high pressure is determined. If yes (Y), the process proceeds to step ST6. If no (N), step ST5 is repeated.

In step ST6, the following operations (1) and (2) are performed, and the process proceeds to step ST7.

(1) Stop supplying air to the pneumatic jack 68.

(2) Close the valve 72 to the closed position. That is, the pressure of the pneumatic jack 68 is kept at a high pressure, and the dancer roller U2*d* is forcibly lowered.

In step ST7, the fixing device F is started to be driven. At this time, an alternate current is supplied to the induction heater 8 to generate heat in order to increase the temperature of the heating belt Fh to a predetermined stand-by temperature, that is, to warm-up the heating belt Fh. At this time, it may be necessary to perform an operation of adjusting the density of an image, an operation of discharging deteriorated developer, or an operation of measuring resistance values. In this case, the intermediate transfer belt B and the photoconductors PRy to PRk are rotated and these operations are started. Then, the process proceeds to step ST8.

In step ST8, whether or not the temperature of the heating belt Fh has increased to the stand-by temperature is determined. If yes (Y), the process proceeds to step ST9. If no (N), step ST8 is repeated.

In step ST9, the following operations (1) and (2) are performed, and the process proceeds to step ST10.

(1) Stop driving the fixing device F.

(2) Set the time t1, before entering sleep mode, in a timer TM1, which is an example of a time measuring unit.

In step ST10, whether or not a job has started is determined. If no (N), the process proceeds to step ST11. If yes (Y), the process proceeds to step ST15.

In step ST11, whether or not the timer TM1 has expired, that is, whether or not the time t1, before entering a sleep mode, has elapsed is determined. If yes (Y), the process proceeds to step ST12. If no (N), the process returns to step ST10.

In step ST12, the valve 72 is opened to the first open position. That is, the air pressure of the pneumatic jack 68 is reduced to the atmospheric pressure. Thus, the pneumatic jack 68 stops forcibly lowering the dancer roller U2*d*. Then, the process proceeds to step ST13.

In step ST13, the controller C causes the printer U to enter a sleep mode by stopping supply of electric power to the LED heads LHy to LHk, the induction heater 8, the motors M1 to M5, and other members so as to reduce power consumption. Then, the process proceeds to step ST14.

In step ST14, whether or not there is an input for exiting the sleep mode, such as reception of image information from the personal computer COM or input to the user interface UI, is determined. If yes (Y), the process returns to step ST2. If no (N), step ST14 is repeated.

In step ST15, the following operations (1) and (2) are performed, and the process proceeds to step ST16.

(1) Move the pressing roller Fp and the second-transfer roller T2*b* to contact positions.

(2) Open the valve 72 to the first open position. That is, the air pressure of the pneumatic jack 68 is reduced to the atmospheric pressure. Thus, the pneumatic jack 68 stops forcibly lowering the dancer roller U2*d*.

In step ST16, whether or not the job has finished is determined. If yes (Y), the process returns to step ST1. If no (N), the process proceeds to step ST17.

In step ST17, whether or not the dancer roller U2*d* is at the lower limit position is determined. If yes (Y), the process proceeds to step ST18. If no (N), the process returns to step ST16.

In step ST18, the following operations (1) and (2) are performed, and the process ends abnormally.

(1) Stop the job. That is, driving of the fixing device F is forcibly stopped.

(2) Display on the display UIb that the continuous sheet S is loose.

Operational Effects of Exemplary Embodiment

When the power of the printer U according to the exemplary embodiment, having the structure described above, is turned on, the pressing roller Fp and the second-transfer roller T2*b* move to the separation positions. At this time, the guide bar 47 moves together with the pressing roller Fp. Accordingly, the continuous sheet S is pushed by the guide bar 47 and separates from the heating belt Fh. In the exemplary embodiment, the continuous sheet S separates also from the intermediate transfer belt B. Thus, as compared with the case the printer U does not have the guide bar 47, even when the heating belt Fh and the intermediate transfer belt B are driven, friction between the continuous sheet S and the belts Fh and B is reduced. Accordingly, damage to the belts Fh and B, smearing of the continuous sheet S, and damage to the continuous sheet S are reduced. Thus, decrease of image quality due to a fixing failure or transfer failure caused by damage to the belts Fh and B or the continuous sheet S and decrease of image quality due to smearing of the continuous sheet S are reduced.

In the exemplary embodiment, when a job is started, the pressing roller Fp and the second-transfer roller T2*b* move to the contact positions. At this time, the guide bar 47 separates from the continuous sheet S. Thus, as compared with a case where the guide bar 47 continues to be in contact with the continuous sheet S, damage to the continuous sheet S and negative effect on an image are reduced.

In the exemplary embodiment, the pressing roller Fp and the second-transfer roller T2*b* move to the separation positions after the job has been finished. Thus, the continuous sheet S separates from the heating belt Fh. If the heating belt Fh, having a high temperature, continues to be in contact with the continuous sheet S after the job has been finished, water held in the continuous sheet S evaporates and creasing or the like might occur or the continuous sheet S might become thermally deformed if the continuous sheet is made of a resin. In contrast, in the exemplary embodiment, the guide bar 47 separates the continuous sheet S from the heating belt Fh after the job has been finished. Thus, the amount of water that evaporates from the continuous sheet S is reduced, and thermal deformation of the continuous sheet is reduced.

In particular, if the printer U does not have the guide bar 47 and only the pressing roller Fp separates from the heating belt Fh, the continuous sheet S might not separate from the heating belt Fh if the continuous sheet S is considerably loose. In contrast, in the exemplary embodiment, the guide bar 47 causes the continuous sheet S to separate from the heating belt Fh without fail. Thus, deformation of the continuous sheet S and the like are reliably reduced.

In the exemplary embodiment, when the printer U is in a stand-by mode or in a sleep mode or when the power is off, the pressing roller Fp is kept separated from the heating belt Fh. Thus, even if a user pulls the continuous sheet S from the post-processing device U6 side or from the sheet feeding device U2 side when, for example, the power is off, friction between the continuous sheet S and the belts Fh and B is reduced. Thus, damage to the continuous sheet S and the belts Fh and B is reduced.

In the exemplary embodiment, the sheet guide 48 is disposed upstream of the guide bar 47. If the printer U does not have the sheet guide 48, when loading a new continuous sheet S to the printer U when the pressing roller Fp is in a separated position, the leading end of the continuous sheet S might collide with the guide bar 47 or the leading end of the continuous sheet S might not move toward the guide roller Rb, so that a loading failure might occur. In contrast, in the exemplary embodiment, the sheet guide 48 guides the continuous sheet S toward the guide roller Rb. Thus, as compared with a case where the printer U does not have the sheet guide 48, occurrence of a loading failure is reduced.

In the exemplary embodiment, the safety cover 49 is supported at a position above the guide bar 47. If the printer U does not have the safety cover 49, the heating belt Fh is exposed. In this case, an operator may touch the heating belt Fh when the operator opens the left cover of the printer U to replace the fixing device F as a unit, to clean the inside of the printer U, or to remove paper jam; or a writing implement, a clip, or the like may drop and contact the heating belt Fh. In contrast, with the exemplary embodiment, damage to the surface of the heating belt Fh due to contact with a writing implement and occurrence of an accident such as an operator suffering from a burn due to contact with the heating belt Fh, which is not cooled sufficiently and has a high-temperature, are reduced.

In the exemplary embodiment, when the pressing roller Fp and the second-transfer roller T2*b* are at the separation positions, the fixing device F is not driven if the tension of the continuous sheet S is insufficient. If the tension of the continuous sheet S is insufficient, it is likely that the continuous sheet S is loose. For example, the continuous sheet S may become loose when a user contacts the continuous sheet S when the power is off. Accordingly, the loosened continuous sheet S might contact the heating belt Fh and the intermediate transfer belt B. If the belts Fh and B are driven when the continuous sheet S is in contact with the belts Fh and B, friction between the belts Fh and B and the continuous sheet S might occur and damage to the belts Fh and B or damage or smearing of the continuous sheet S might occur. In contrast, in the exemplary embodiment, the fixing device F is not driven if the continuous sheet S is likely to be loose. Thus, as compared with a case where the fixing device F is driven when the tension is insufficient, damage to the heating belt Fh or the intermediate transfer belt B is reduced. In the exemplary embodiment, if the tension of the continuous sheet S becomes insufficient while a job is being performed, the job is forcibly stopped and the fixing device F is forcibly stopped. Accordingly, friction between the continuous sheet S and the heating belt Fh or the like is reduced, and decrease of image quality is reduced.

In the exemplary embodiment, when the pressing roller Fp and the second-transfer roller T2*b* move to the separation positions, the pneumatic jack 68 is operated to forcibly increase the tension of the continuous sheet S. Then, the fixing device F is driven and the fixing device F is warmed up in a state in which the tension of the continuous sheet S is higher than that when a job is being performed. When the fixing device F is driven in a state in which the pressing roller Fp and the second-transfer roller T2*b* are at the separation positions, if the tension of the continuous sheet S is substantially the same as that when the job is performed, the continuous sheet S might contact the belts Fh and B due to airflow or vibration that occurs as the belts Fh and B are driven. Accordingly, damage to the belts Fh and B or the like might occur.

In contrast, in the exemplary embodiment, if the fixing device F is driven in a state in which the pressing roller Fp and the second-transfer roller T2*b* are at the separation positions, the tension of the continuous sheet S is kept higher than that when the job is performed. Accordingly, the continuous sheet S does not become loose, and the continuous sheet S is not likely to contact the belts Fh and B even if airflow or vibration occurs. Thus, as compared with a case where the tension of the continuous sheet S is not increased, damage the belts Fh and B and the like is reduced.

Modifications

The present invention is not limited to the exemplary embodiment described above, which may be modified in various ways within the spirit and scope of the present invention described in the claims. Modifications (H01) to (H015) according to the present invention are as follows.

(H01) In the exemplary embodiment, the printer U, which is an example of an image forming apparatus, is described. However, this is not a limitation. For example, an image forming apparatus according to the present invention may be a copier, a FAX, or a multifunctional machine having all or some of the functions of these.

(H02) In the exemplary embodiment, the printer U uses four-color developers. However, this is not a limitation. For example, the present invention may be applied to a monochrome image forming apparatus or a color image forming apparatus that uses two, three, five, or more colors.

(H03) In the exemplary embodiment, the heating belt Fh is used as an example of a first fixing member. However, this is not a limitation. For example, a heat fixing member having a roller-like shape or a drum-like shape may be used. Likewise, the intermediate transfer belt B is used as an example of an image carrier. However, this is not a limitation. An intermediate transfer body having a drum-like shape may be used. The present invention may be applied to a monochrome image forming apparatus that does not have an intermediate transfer body and that has a structure in which a transfer roller is capable of contacting or separating from a photoconductor, which is an example of an image carrier.

(H04) In the exemplary embodiment, the post-processing device includes the lamination device U6*b*. However, this is not a limitation. For example, any post-processing device, such as a device for forming a folding line, a device for forming a hole, or a device for cutting a label portion, may be connected to the printer U.

(H05) In the exemplary embodiment, the pneumatic jack 68 and the like are used as an example of a tension application device. However, this is not a limitation. Any structure that forcibly moves the dancer roller U2*d* to increase the tension of the continuous sheet S, such as a solenoid, an eccentric cam, or a hydraulic jack, may be used. It is possible to increase the tension by temporarily rotating one or both of the sheet feeding member U2*a* and the winding roller U4*a* in the winding direction, and the sheet feeding member U2*a* and the winding roller U4*a* may be returned to the original state after the warm-up operation has been finished. It is possible to increase the tension by moving a member other than the dancer roller U2*d*. It is possible to increase the tension in a region including the second-transfer region Q4 and the fixing region Q5 by holding the continuous sheet S with a clip or the like and pulling the continuous sheet S in the transport direction only when increasing the tension. The tension application device may be omitted.

(H06) In the exemplary embodiment, the printer U includes the powder supply device Fk. However, this is not a limitation. The powder supply device Fk may be omitted if powder has been applied to the continuous sheet S before the continuous sheet S is set in the sheet feeding device U2. An operator may hit a roll of continuous sheet S, to which powder has been applied beforehand, with an excess-removing member, such as a hammer, to remove excess adhesion-suppressing agent, and then the roll of the continuous sheet S may be set in the sheet feeding device U2 and used.

(H07) In the exemplary embodiment, the position of the powder supply device Fk is not limited to the position shown in the exemplary embodiment. For example, the powder supply device Fk may be disposed at any position that is upstream of the second-transfer region Q4. The powder supply device Fk may be disposed in the sheet feeding device U2 instead of the printer body U1. Accordingly, in the sheet feeding device U2, the powder supply device Fk may be disposed downstream of the tension application unit U2*b* or upstream of the tension application unit U2*b*.

(H08) In the exemplary embodiment, the microswitch 62 detects decrease in the tension of the continuous sheet S. However, this is not a limitation. Instead of the microswitch, any detection member that is capable of detecting the position of the dancer roller U2*d*, such as an optical sensor, may be used. In the exemplary embodiment, decrease in the tension of the continuous sheet S is estimated from the position of the dancer roller U2*d*. However, decrease in the tension may be detected by using a method that does not use the position of the dancer roller U2*d*, such as a method of detecting decrease in the tension on the basis of the position of a member that is not the dancer roller U2*d* or a method of detecting decrease in the tension by detecting displacement or vibration of the continuous sheet S that occurs when air is blown against the continuous sheet S.

(H09) In the exemplary embodiment, a method of stopping the motor M5 of the heating belt Fh is used to forcibly stop the fixing device F when the tension of the continuous sheet S decreases. However, this is not a limitation. For example, the fixing device F may include a power switch, such as an interlock switch, for stopping supply of electric power, and supply of electric power may be stopped by controlling the switch if the tension decreases.

(H010) In the exemplary embodiment, the sheet guide 48 and the safety cover 49 may be omitted.

(H011) In the exemplary embodiment, the guide bar 47 has a bar-like shape. However, this is not a limitation. The guide bar 47 may have any appropriate shape, such as a plate-like shape, a prism-like shape, or a roller-like shape that rotates.

(H012) In the exemplary embodiment, the pressing roller Fp contacts or separates from the heating belt Fh. However, this is not a limitation. The heating belt Fh may be moved, or both of the heating belt Fh and the pressing roller Fp may be moved. In the exemplary embodiment, an eccentric cam and a motor are used to move the pressing roller Fp. However, this is not a limitation. For example, a driving mechanism, such as a solenoid, may be used to move the pressing roller Fp.

(H013) In the exemplary embodiment, in order to reduce the number of motors, eccentric cams, and other components, the guide bar 47 is moved together with the pressing roller Fp. However, this is not a limitation. The guide bar 47 may be independently moved by using a motor and an eccentric cam that are different from those for the pressing roller Fp.

(H014) In the exemplary embodiment, the tension of the continuous sheet S is increased if the belts Fh and B are driven when the pressing roller Fp and the second-transfer roller T2*b* are separated from each other. However, this is not a limitation. For example, the tension of the continuous sheet S may be increased also when the power is off or the printer U is in a sleep mode. In this case, if a solenoid or a motor is used to increase the tension, it is not possible to keep a high tension when the power is turned off and supply of electric power is stopped. In contrast, the pneumatic jack 68, which is used in the exemplary embodiment, is capable of keeping the air pressure when the valve 72 is closed to the closed position. Thus, even when the power is off, it is possible to keep the air pressure of the pneumatic jack 68 at a high pressure and to keep the tension of the continuous sheet S at a high tension. In this case, even when the power is off, it is possible to suppress friction between the continuous sheet S and the belts Fh and B.

(H015) In the exemplary embodiment, the printer includes a structure that stops driving of the fixing device F when the tension of the continuous sheet S is low. However, a structure for determining whether or not the tension is high or low may be omitted. In the exemplary embodiment, the printer U includes a structure that drives the fixing device F after increasing the tension of the continuous sheet S. However, a structure for increasing the tension may be omitted.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a transfer unit configured to transfer an image carried by the image carrier to a continuous medium;

a fixing device including a first fixing member configured to contact the continuous medium and to heat the image transferred to the continuous medium and a second fixing member that is disposed so as to face the first fixing member with the continuous medium therebetween, the second fixing member being configured to press the image, the fixing device being configured to fix the image transferred to the continuous medium, the fixing device being configured so that the second fixing member is capable of contacting with or separating from the first fixing member;

a separation member configured to contact the continuous medium and to separate the continuous medium from the first fixing member in response to the first fixing member and the second fixing member separating from each other; and a movement mechanism configured to support and move the second fixing member, wherein the movement mechanism includes the separation member, and wherein the separation member is configured to press the recording medium toward the second fixing member in response to the second fixing member separating from the first fixing member.

2. The image forming apparatus according to claim 1, comprising:

a movement mechanism configured to cause the first fixing member and the second fixing member to contact or separate from each other, the movement mechanism including the separation member.

3. The image forming apparatus according to claim 2, wherein the movement mechanism includes a movable member that supports the second fixing member and that is movable in a direction in which the second fixing member contacts or separates from the first fixing member, and wherein the separation member is supported by the movable member.

4. The image forming apparatus according to claim 3, comprising:

a guide portion that is supported at a position upstream of the separation member in a transport direction of the continuous medium and that is configured to guide a leading end of a continuous medium in response to a continuous medium being newly loaded.

5. The image forming apparatus according to claim 2, comprising:

a guide portion that is supported at a position upstream of the separation member in a transport direction of the continuous medium and that is configured to guide a leading end of a continuous medium in response to a continuous medium being newly loaded.

6. The image forming apparatus according to claim 2, wherein the separation member is disposed downstream of the first fixing member in a transport direction of the continuous medium, and wherein the image forming apparatus further comprises a cover member that is supported at a position downstream of the separation member in the transport direction of the continuous medium and that covers a downstream portion of the first fixing member.

7. The image forming apparatus according to claim 1, comprising:

a movement mechanism that supports the second fixing member and is configured to move the second fixing member relative to the first fixing member, wherein the movement mechanism includes the separation member, and the separation member is configured to press the medium toward the second fixing member in response to the second fixing member separating from the first fixing member.

8. The image forming apparatus according to claim 7, wherein the movement mechanism includes a movable member that supports the second fixing member and that is movable in a direction in which the second fixing member contacts or separates from the first fixing member, and wherein the separation member is supported by the movable member.

9. The image forming apparatus according to claim 8, comprising:

a guide portion that is supported at a position upstream of the separation member in a transport direction of the continuous medium and that is configured to guide a leading end of a continuous medium in response to a continuous medium being newly loaded.

10. The image forming apparatus according to claim 7, comprising:

a guide portion that is supported at a position upstream of the separation member in a transport direction of the continuous medium and that is configured to guide a leading end of a continuous medium in response to a continuous medium being newly loaded.

11. The image forming apparatus according to claim 7, wherein the separation member is disposed downstream of the first fixing member in a transport direction of the continuous medium, and wherein the image forming apparatus further comprises a cover member that is supported at a position downstream of the separation member in the transport direction of the continuous medium and that covers a downstream portion of the first fixing member.

12. The image forming apparatus according to claim 1, comprising:

a movement mechanism that supports the second fixing member and is configured to move the second fixing member relative to the first fixing member, wherein the movement mechanism includes the separation member, and the second fixing member and the separation member are disposed so that the medium is interposed therebetween.

13. The image forming apparatus according to claim 12, wherein the movement mechanism includes a movable member that supports the second fixing member and that is movable in a direction in which the second fixing member contacts or separates from the first fixing member, and wherein the separation member is supported by the movable member.

14. The image forming apparatus according to claim 13, comprising:

a guide portion that is supported at a position upstream of the separation member in a transport direction of the continuous medium and that is configured to guide a leading end of a continuous medium in response to a continuous medium being newly loaded.

15. The image forming apparatus according to claim 12, comprising:

a guide portion that is supported at a position upstream of the separation member in a transport direction of the continuous medium and that is configured to guide a leading end of a continuous medium in response to a continuous medium being newly loaded.

16. The image forming apparatus according to claim 12, wherein the separation member is disposed downstream of the first fixing member in the transport direction of the continuous medium, and wherein the image forming apparatus comprises a cover member that is supported at a position downstream of the separation member in the transport direction of the continuous medium and that covers a downstream portion of the first fixing member.

17. The image forming apparatus according to claim 1, comprising:

a guide portion that is supported at a position upstream of the separation member in a transport direction of the continuous medium and that is configured to guide a leading end of a continuous medium in response to a continuous medium being newly loaded.

18. The image forming apparatus according to claim 1, wherein the separation member is disposed downstream of the first fixing member in a transport direction of the continuous medium, and wherein the image forming apparatus further comprises a cover member that is supported at a position downstream of the separation member in the transport direction of the continuous medium and that covers a downstream portion of the first fixing member.

19. A fixing device comprising:

a heating member configured to heat an unfixed image on a surface of a medium;

a pressing member that is disposed so as to face the heating member with the medium therebetween and that is configured to press the unfixed image;

a movement mechanism configured to support and move the pressing member, and configured to cause the pressing member to contact with or separate from the heating member; and a separation member configured to separate the medium from the heating member in response to the heating member and the pressing member separating from each other, wherein the movement mechanism includes the separation member, and wherein the separation member is configured to press the medium toward the pressing member in response to the pressing member separating from the heating member.

20. The fixing device according to claim 19, wherein the medium is a continuous medium.

21. A fixing device comprising:

a first fixing member configured to contact a continuous medium and to heat an image transferred to the continuous medium; and a second fixing member that is disposed so as to face the first fixing member with the continuous medium therebetween, the second fixing member being configured to press the image, the fixing device being configured to fix the image transferred to the continuous medium, the fixing device being configured so that the second fixing member is capable of contacting with or separating from the first fixing member, wherein the fixing device is configured such that, in response to the first fixing member and the second fixing member separating from each other, a separation member contacts the continuous medium and separates the continuous medium from the first fixing member, wherein the second fixing member is supported by and is configured to be moved by a movement mechanism, wherein the movement mechanism includes the separation member, and wherein the separation member and the second fixing member are disposed so as to sandwich the continuous medium.

* * * * *